US008609972B2

(12) United States Patent
Harada et al.

(10) Patent No.: US 8,609,972 B2
(45) Date of Patent: Dec. 17, 2013

(54) PERFORMANCE APPARATUS AND ELECTRONIC MUSICAL INSTRUMENT OPERABLE IN PLURAL OPERATION MODES DETERMINED BASED ON MOVEMENT OPERATION OF PERFORMANCE APPARATUS

(75) Inventors: Eiichi Harada, Hamura (JP); Naotaka Uehara, Higashmurayama (JP)

(73) Assignee: Casio Computer Co., Ltd., Tokyo (JP)

( * ) Notice: Subject to any disclaimer, the term of this patent is extended or adjusted under 35 U.S.C. 154(b) by 208 days.

(21) Appl. No.: 13/179,064

(22) Filed: Jul. 8, 2011

(65) Prior Publication Data

US 2012/0006181 A1 Jan. 12, 2012

(30) Foreign Application Priority Data

Jul. 9, 2010 (JP) ..... 2010-156416

(51) Int. Cl.
*G10H 1/02* (2006.01)
*G10H 1/06* (2006.01)

(52) U.S. Cl.
USPC ..... 84/735; 84/626; 84/737

(58) Field of Classification Search
USPC ..... 84/735
See application file for complete search history.

(56) References Cited

U.S. PATENT DOCUMENTS

| | | | | |
|---|---|---|---|---|
| 5,058,480 | A | 10/1991 | Suzuki et al. | |
| 7,363,718 | B2 * | 4/2008 | Sato et al. | 33/356 |
| 7,667,129 | B2 * | 2/2010 | Chidlaw et al. | 84/723 |

FOREIGN PATENT DOCUMENTS

| | | | |
|---|---|---|---|
| JP | 2663503 | B2 | 10/1997 |
| JP | 2007-256736 | A | 10/2007 |

* cited by examiner

*Primary Examiner* — Christopher Uhlir
(74) *Attorney, Agent, or Firm* — Holtz, Holtz, Goodman & Chick, PC

(57) ABSTRACT

A performance apparatus 11 is provided with a first acceleration sensor 22 at its head portion and a second acceleration sensor 23 at its base portion. CPU 21 determines operation of the performance apparatus 11 during a period from the first timing to the second timing, based on a first acceleration-sensor value and a second acceleration-sensor value, and determines operation mode corresponding to the operation of the performance apparatus. Referring to a tone-color table stored in RAM 26, CPU 21 determines a tone color of musical tones to be generated, based on the determined operation mode.

8 Claims, 21 Drawing Sheets

FIG.11

1101

| OPERATION MODES | CONDITIONS | TONE COLORS |
|---|---|---|
| FIRST OPERATION MODE | \| Da \| > Dth1, \| Db \| > Dth1<br>\| Da – Db \| < Dth2<br>Da, Db same sign | TONE COLOR A (PIANO) |
| SECOND OPERATION MODE | \| Da \| > Dth1, \| Db \| > Dth2 | TONE COLOR B (TOM: PERCUSSION) |
| THIRD OPERATION MODE | \| Da \| > Dth1<br>Dth2 < \| Db \| < Dth1<br>Da, Db same sign | TONE COLOR C (GUITAR) |
| FOURTH OPERATION MODE | \| Da \| > Dth3, \| Db \| > Dth3<br>Da, Db different sign | TONE COLOR D (TRUMPET) |
| OTHER | OTHER | NOP |

1102

1103

1700

| $\theta_{Rd}$ | $-180 \le \theta_d < -\theta 2$ | $-\theta 2 \le \theta_d < -\theta 1$ | $-\theta 1 \le \theta_d < 0$ | $0 \le \theta_d < \theta 1$ | $\theta 1 \le \theta_d < \theta 2$ | $\theta 2 \le \theta_d < 180$ |
|---|---|---|---|---|---|---|
| PITCH | A(Ra) | G(Sol) | F(Fa) | E(Mi) | D(Re) | C(Do) |

PERFORMANCE APPARATUS AND ELECTRONIC MUSICAL INSTRUMENT OPERABLE IN PLURAL OPERATION MODES DETERMINED BASED ON MOVEMENT OPERATION OF PERFORMANCE APPARATUS

CROSS-REFERENCE TO RELATED APPLICATIONS

The present application is based upon and claims the benefit of priority from the prior Japanese Patent Application No. 2010-156416, file Jul. 9, 2010, and the entire contents of which are incorporated herein by reference.

BACKGROUND OF THE INVENTION

1. Field of the Invention

The present invention relates to a performance apparatus and an electronic musical instrument, which generate musical tones, when held and swung by a player with his or her hand.

2. Description of the Related Art

An electronic musical instrument has been proposed, which comprises an elongated member of a stick type with a sensor provided therein, and generates musical tones when the sensor detects a movement of the elongated member. Particularly, in the electronic musical instrument, the elongated member of a stick type has a shape of a drumstick and is constructed so as to generate musical tones as if percussion instruments generate sounds in response to player's motion of striking drums and/or Japanese drums.

For instance, Patent Gazette No. 2,663,503 discloses a performance apparatus, which is provided with an acceleration sensor in its stick-type member, and generates a musical tone when a certain period of time has lapsed after an output (acceleration-sensor value) from the acceleration sensor reaches a predetermined threshold value.

In the performance apparatus disclosed in Patent Gazette No. 2,663,503, generation of musical tones is simply controlled based on the acceleration-sensor values of the stick-type member and therefore, the performance apparatus has a drawback that it is not easy for a player to change musical tones as he or she desires.

Meanwhile, Japanese Patent No. 2007-256736 A discloses an apparatus, which is capable of generating musical tones having plural tone colors. The apparatus is provided with a geomagnetic sensor in addition to an acceleration sensor, and detects an orientation of a stick-type member based on a sensor value obtained by the geomagnetic sensor, selecting based on the detected orientation one from among plural tone colors of musical tones.

SUMMARY OF THE INVENTION

When a player holds and swings a stick type member, the member moves in various ways depending on the position where the member is initially held by the player or movement of the player's armor wrist. The present invention has an object to provide a performance apparatus and an electronic musical instrument, which allow the player to change a musical-tone composing element of musical tones to be generated as his or her desired by the manner in which he or she swings the stick type member down.

According to one aspect of the invention, there is provided a performance apparatus used with musical-tone generating equipment for generating musical tones, the apparatus, which comprises a holding member extending in an longitudinal direction to be held by a player with his or her hand, a first acceleration sensor provided in a head portion of the holding member, for obtaining a first acceleration-sensor value, which contains three components along three axes, respectively, a second acceleration sensor provided in other portion of the holding member, for obtaining a second acceleration-sensor value, which contains three components along three axes, respectively, wherein the other portion of the holding member is a portion opposite to the base portion of the holding member, and a controlling unit for giving the musical-tone generating equipment an instruction of generating a musical tone, wherein the controlling unit comprises a sound-generation instructing unit for obtaining a timing for a sound generation base on at least one of the first acceleration-sensor value obtained by the first acceleration sensor and the second acceleration-sensor value obtained by the second acceleration sensor and for giving an instruction of generating a musical tone to the musical-tone generating equipment at the obtained timing, an operation-mode determining unit for determining an operation mode corresponding to an operation of the holding member base on the first acceleration-sensor value obtained by the first acceleration sensor and the second acceleration-sensor value obtained by the second acceleration sensor, and a musical-tone composing element determining unit for determining a musical-tone composing element of a musical tone to be generated, based on the operation mode determined by the operation-mode determining unit.

According to one aspect of the invention, there is provided a performance apparatus used with musical-tone generating equipment for generating musical tones, the apparatus, which comprises a holding member extending in an longitudinal direction to be held by a player with his or her hand, a first acceleration sensor provided in a head portion of the holding member, for obtaining a first acceleration-sensor value, which contains three components along three axes, respectively, a second acceleration sensor provided in a base portion of the holding member, for obtaining a second acceleration-sensor value, which contains three components along three axes, respectively, wherein the base portion of the holding member is a portion opposite to the head portion of the holding member, and a controlling unit for giving the musical-tone generating equipment an instruction of generating a musical tone, wherein the controlling unit comprises a sound-generation instructing unit for obtaining a timing for a sound generation based on at least one of the first acceleration-sensor value obtained by the first acceleration sensor and the second acceleration-sensor value obtained by the second acceleration sensor and for giving an instruction of generating a musical tone to the musical-tone generating equipment at the obtained timing, an operation-mode determining unit for determining an operation mode corresponding to an operation of the holding member based on the first acceleration-sensor value obtained by the first acceleration sensor and the second acceleration-sensor value obtained by the second acceleration sensor, and a musical-tone composing element determining unit for determining a musical-tone composing element of a musical tone to be generated, based on the operation mode determined by the operation-mode determining unit.

According to another aspect of the invention, there is provided an electronic musical instrument, which comprises a performance apparatus and a musical instrument unit provided with a musical-tone generating unit for generating musical tones, wherein both the performance apparatus and the musical instrument unit have a communication unit, and the performance apparatus comprises a holding member extending in an longitudinal direction to be held by a player with his or her hand, a first acceleration sensor provided in a head portion of the holding member, for obtaining a first acceleration-sensor value, which contains three components along three axes, respectively, a second acceleration sensor provided in a base portion of the holding member, for obtaining a second acceleration-sensor value, which contains three components along three axes, respectively, wherein the base portion of the holding member is a portion opposite to the head portion of the holding member, and a controlling unit for giving an instruction of generating a musical tone to the musical-tone generating unit of the musical instrument unit, wherein the controlling unit comprises a sound-generation instructing unit for obtaining a timing for a sound generation based on at least one of the first acceleration-sensor value obtained by the first acceleration sensor and the second acceleration-sensor value obtained by the second acceleration sensor and for giving an instruction of generating a musical tone to the musical-tone generating unit at the obtained timing, an operation-mode determining unit for determining an operation mode corresponding to an operation of the holding member based on the first acceleration-sensor value obtained by the first acceleration sensor and the second acceleration-sensor value obtained by the second acceleration sensor, and a musical-tone composing element determining unit for determining a musical-tone composing element of a musical tone to be generated, based on the operation mode determined by the operation-mode determining unit.

According to another aspect of the invention, there is provided a performance apparatus used with tone generating equipment for generating tones, which comprises a holding member extending in an longitudinal direction to be held by a player with his or her hand, a first acceleration sensor provided in a head portion of the holding member, for obtaining a first acceleration-sensor value, which contains three components along three axes, respectively, a second acceleration sensor provided in a base portion of the holding member, for obtaining a second acceleration-sensor value, which contains three components along three axes, respectively, wherein the base portion of the holding member is a portion opposite to the head portion of the holding member; and a controlling unit for giving the tone generating equipment an instruction of generating a tone, wherein, the controlling unit comprises a sound-generation instructing unit for obtaining a timing for a sound generation based on at least one of the first acceleration-sensor value obtained by the first acceleration sensor and the second acceleration-sensor value obtained by the second acceleration sensor and for giving an instruction of generating a tone to the tone generating equipment at the obtained timing, an operation-mode determining unit for determining an operation mode corresponding to an operation of the holding member based on the first acceleration-sensor value obtained by the first acceleration sensor and the second acceleration-sensor value obtained by the second acceleration sensor, and a tone composing element determining unit for determining a tone composing element of a tone to be generated, based on the operation mode determined by the operation-mode determining unit.

BRIEF DESCRIPTION OF THE DRAWINGS

FIG. 11 is a view showing an example of a tone-color table prepared in the first embodiment of the invention.

DETAILED DESCRIPTION OF THE PREFERRED EMBODIMENTS

Figure 1:
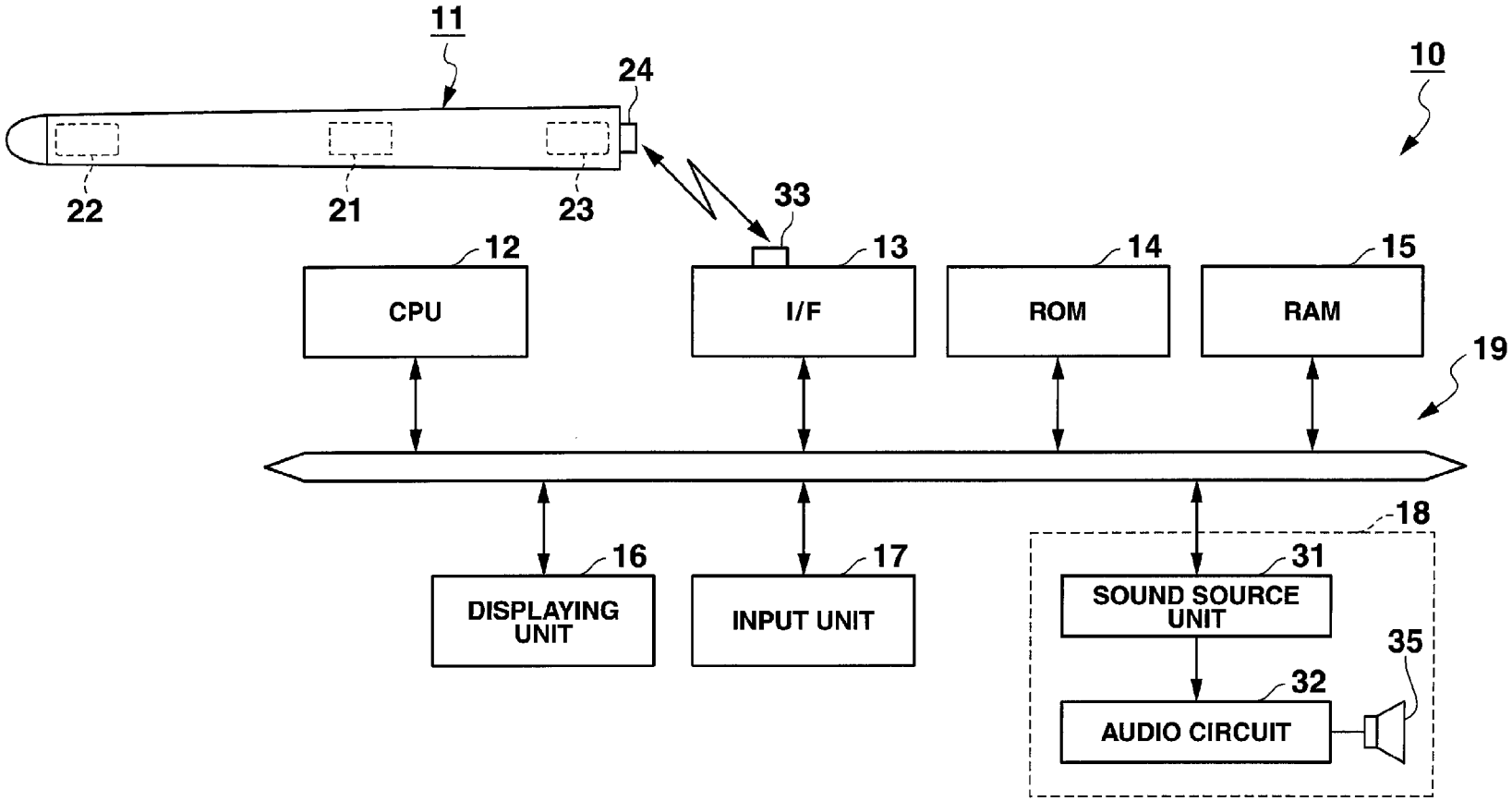
FIG. 1 is a block diagram of a configuration of an electronic musical instrument according to the first embodiment of the invention.

Now, embodiments of the present invention will be described with reference to the accompanying drawings in detail. FIG. 1 is a block diagram of a configuration of an electronic musical instrument according to the first embodiment of the invention. As shown in FIG. 1, the electronic musical instrument 10 according to the first embodiment has a stick-type performance apparatus 11, which extends in its longitudinal direction to be held or gripped by a player with hand. The performance apparatus 11 is held or ripped by the player to be swung. The electronic musical instrument 10 is provided with a musical instrument unit 19 for generating musical tones. The musical instrument unit 19 comprises CPU 12, an interface (I/F) 13, ROM 14, RAM 15, a displaying unit 16, an input unit 17 and a sound system 18. As will be described in detail later, the performance apparatus 11 is provided with a second acceleration sensor 23 and a first acceleration sensor 22 respectively on the base side and the side opposite to the base side of the elongated performance apparatus 11. The player grips or holds the base to swing the elongated performance apparatus 11.

The I/F 13 of the musical instrument unit 19 serves to receive data (for instance, a note-on event) from the performance apparatus 11 to store the received data in RAM 15 and to give notice of receipt of such data to CPU 12. In the present embodiment, the performance apparatus 11 is provided with an infrared communication device 24 at the edge of the base and the I/F 13 of the musical instrument unit 19 is also provided with an infrared communication device 33. The infrared communication device 33 of I/F 13 receives infrared light generated by the infrared communication device 24 of the performance device 11, whereby the musical instrument unit 19 can receive data from the performance apparatus 11.

CPU 12 controls whole operation of the electronic musical instrument 10. In particular, CPU 12 serves to perform various processes including a controlling operation of the musical instrument unit 19, a detecting operation of a manipulated state of key switches (not shown) in the input unit 17 and a generating operation of musical tones based on note-on events received through I/F 13.

ROM 14 stores programs for executing various processes, wherein the processes include a process for controlling the whole operation of the electronic musical instrument 10, a process for controlling the operation of the musical instrument unit 19, a process for detecting the operated state of the key switches (not shown) in the input unit 17, and a process for generating musical tones based on note-on events received through I/F 13. ROM 14 has a waveform-data area for storing waveform data of various tone colors, including waveform data of wind instruments such as flutes, saxes and trumpets, waveform data of keyboard instruments such as pianos, waveform data of string instruments such as guitars, and waveform data of percussion instruments such as bass drums, high-hats, snare drums and cymbals.

RAM 15 serves to store programs read from ROM 14 and to store data and parameters generated during the course of the executed process. The data generated in the process includes the manipulated state of the switches in the input unit 17 and sensor values received through I/F 13.

The displaying unit 16 has, for example, a liquid crystal displaying device (not shown) and is able to display a selected tone color and contents of a tone-color table, wherein the tone-color table associates operation modes (to be described later) with tone colors of musical tones, respectively. The input unit 17 includes various switches (not shown).

The sound system 18 comprises a sound source unit 31, an audio circuit 32 and a speaker 35. Upon receipt of an instruction from CPU 12, the sound source unit 31 reads waveform data from the waveform-data area of ROM 14 to generate and output musical-tone data. The audio circuit 32 converts the musical-tone data supplied from the sound source unit 31 into an analog signal and amplifies the analog signal to output the amplified signal from the speaker 35, whereby musical tones are output from the speaker 35.

Figure 2:
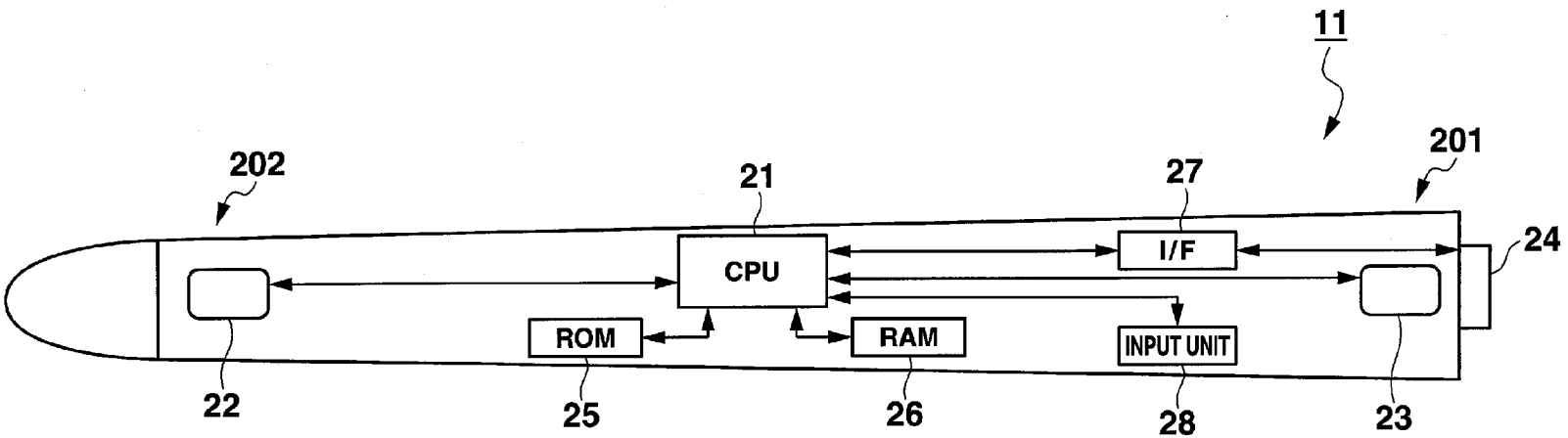
FIG. 2 is a block diagram of a configuration of a performance apparatus in the first embodiment of the invention.

FIG. 2 is a block diagram of a configuration of the performance apparatus 11 in the first embodiment of the invention. In the performance apparatus 11 shown in FIG. 2, the portion (Refer to Reference Number: 201) of the performance apparatus 11 to be held or gripped by the player is called "base", and the portion (Refer to Reference Number: 202) of the performance apparatus 11 opposite to the base is called "head". As shown in FIG. 2, the performance apparatus 11 is provided with the first acceleration sensor 22 on the head and the second acceleration sensor 23 on the base, which the player holds or grips with his or her hand. The acceleration sensors 22 and 23 are 3-dimensional sensors of a capacitance type and/or of a piezoresistive type. The 3-dimensional acceleration sensors 22 and 23 are able to output components of acceleration-sensor values representing acceleration, which are yielded in the base and head in three axial directions such as in X, Y and Z-direction, respectively, when the performance apparatus 11 is swung by the player.

The player generates a parallel movement of a stick or a rotational movement of the stick with the center at the player's wrist, by gripping a portion (for example, the base 201) of the stick and swinging the stick. FIGS. 3*a*, 3*b* and 3*c* and FIGS. 4*a* and 4*b* are views schematically showing movements of the performance apparatus 11 swung by the player in the first embodiment. In the present embodiment of the invention, the movements of the performance apparatus 11 are divided into four modes. In the present embodiment, as will be described later, the movements of the performance apparatus 11 are associated with operation modes, respectively. Further, the present embodiment is arranged such that a tone color of musical tones to be generated is determined every operation mode and musical tones having the determined tone color are generated every operation mode.

Figure 3A:
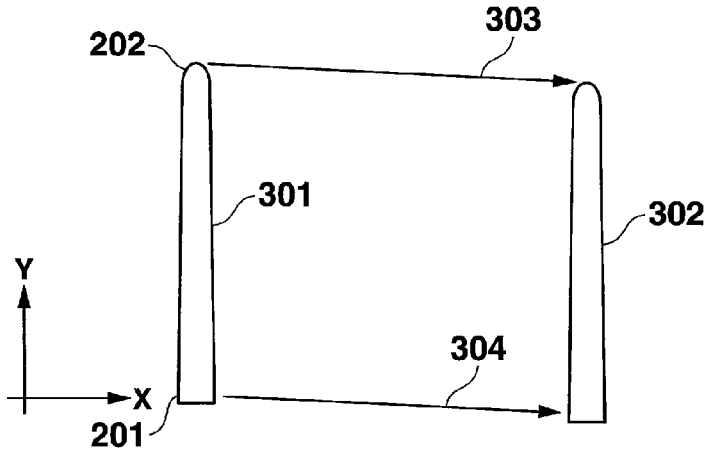
FIGS. 3*a*, 3*b* and 3*c* are views schematically showing movements of the performance apparatus swung by a player in the first embodiment of the invention.

FIG. 3*a* is a view for explaining the first operation mode in the first embodiment of the invention. In FIG. 3*a*, an axis in the longitudinal direction of the performance apparatus 11 is set as the Y-axis and an axis in the direction perpendicular to the Y-axis is set as the X-axis. In the following description, it is assumed that the performance apparatus 11 is swung in the direction of the X-axis, when the performance apparatus 11 is swung frontward as seen from the player. The same assumption will apply to FIGS. 3*b* and 3*c* and FIGS. 4*a* and 4*b*. Therefore, in FIGS. 3*a*, 3*b* and 3*c* and FIGS. 4*a* and 4*b*, the player takes his or her position on the left side of the performance apparatus 11 illustrated in the drawings.

Figure 5:
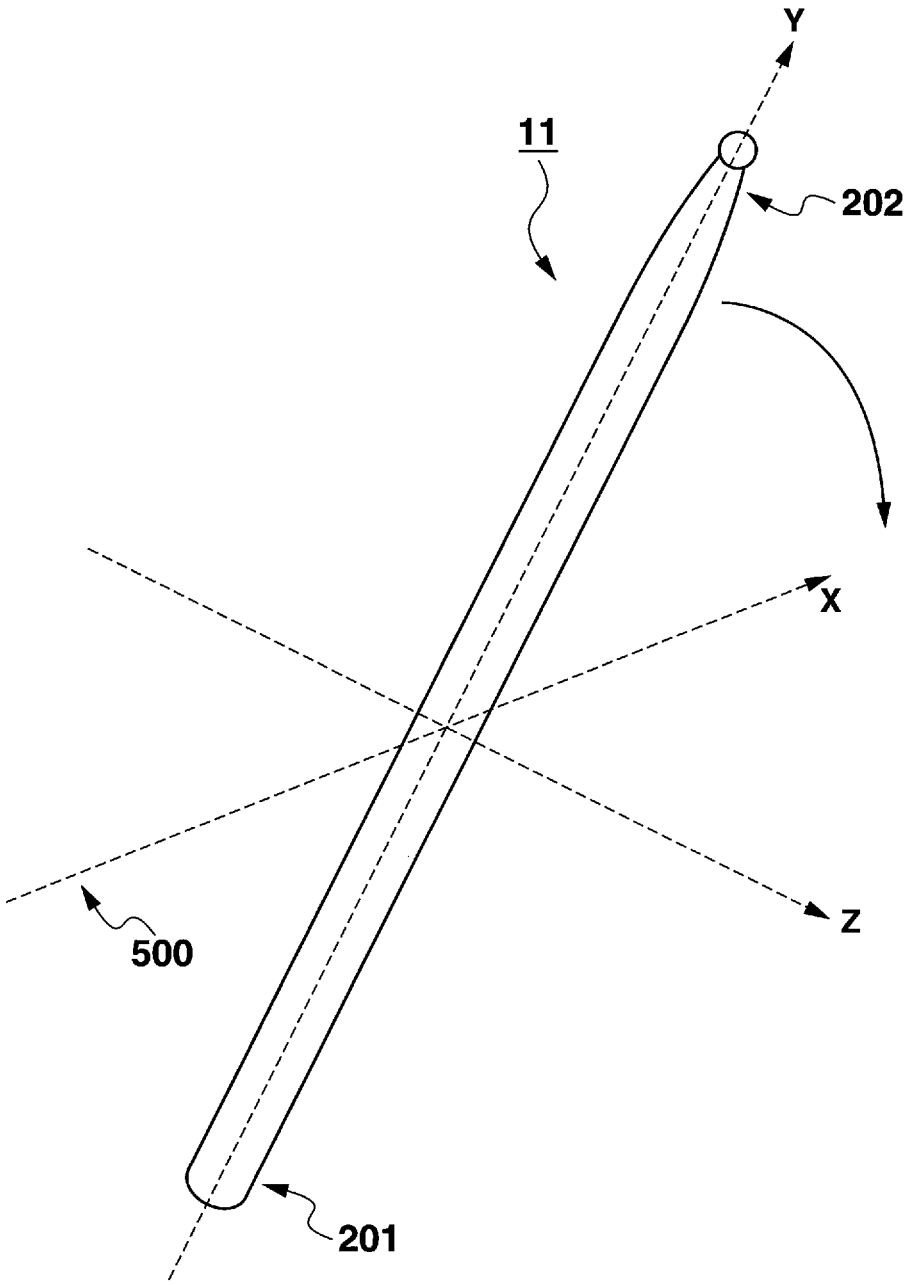
FIG. 5 is a perspective view showing an external appearance of the performance apparatus according to the first embodiment of the invention.

FIG. 5 is a perspective view showing an external appearance of the performance apparatus 11 according to the first embodiment of the invention. In FIG. 5, the player takes his or her position in the negative region (Refer to Reference Number: 500) of the X-axis. The Z-axis is an axis in the direction running from left to right as seen from the player. When the player grips the base 201 of the performance apparatus 11 and swings the same down, the performance apparatus 11 will be moved in the direction of an arrow "A".

FIG. 3*a* is a view showing the parallel movement of the performance apparatus 11, wherein the player holds the performance apparatus 11 and stretched his or her arm forwards to move the performance apparatus 11 forwards. As shown in FIG. 3*a*, the performance apparatus 11 is initially held at a position 301 and then moved finally to a position 302. A vector 303 represents a displacement of the head 202 of the performance apparatus 11 and a vector 304 represents a displacement of the base 201 of the performance apparatus 11.

The present operation mode has the feature that the vector 303 and the vector 304 have substantially the same magnitude.

Figure 3B:
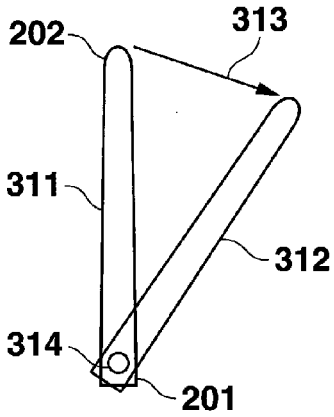

FIG. 3*b* is a view for explaining the second operation mode. In FIG. 3*b*, a rotational movement of the performance apparatus 11 is shown, wherein the player holds the base 201 of the performance apparatus 11 and turns his or her wrist to swing the performance apparatus 11 down. As shown in FIG. 3*b*, the performance apparatus 11 is initially held at a position 311 and then moved finally to a position 312. A vector 313 represents a displacement of the head 202 of the performance apparatus 11. A reference number 314 denotes a node point corresponding to a position of the wrist of the player. In this case, the performance apparatus 11 rotates about its base 201 or the node point 314. This operation mode has the feature that a displacement of the base 201 is substantially null and the vector 313 of the head 202 has a predetermined magnitude.

Figure 3C:
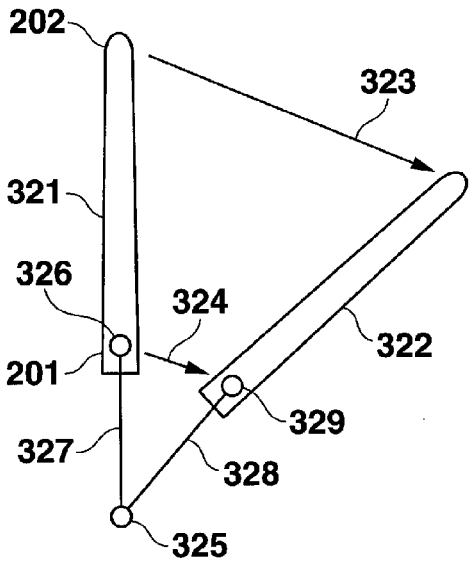

FIG. 3*c* is a view for explaining the third operation mode. In FIG. 3*c*, a rotational movement of the performance apparatus 11 is shown, wherein the player holds the base 201 of the performance apparatus 11 and swings his or her wrist and arm up-and-down with a fulcrum at his or her elbow to swing the performance apparatus 11 down. As shown in FIG. 3*c*, the performance apparatus 11 is initially held at a position 321 and then moved finally to a position 322. Reference numbers 327, 328 indicate arms as links, and a reference number 325 indicates the elbow of the player as the node point. Reference numbers 326, 329 indicate the wrist of the player as the node point. As indicated in FIG. 3*c*, in this case the performance apparatus 11 moves with the node points of the elbow and wrist of the player and links of the arms of the player. A vector 324 represents a displacement of the base 201 and a vector 323 represents a displacement of the head 202. This operation mode has the feature that the vectors 323 and 324 have the same direction and the vector 323 has a larger magnitude than the vector 324.

Figure 4A:
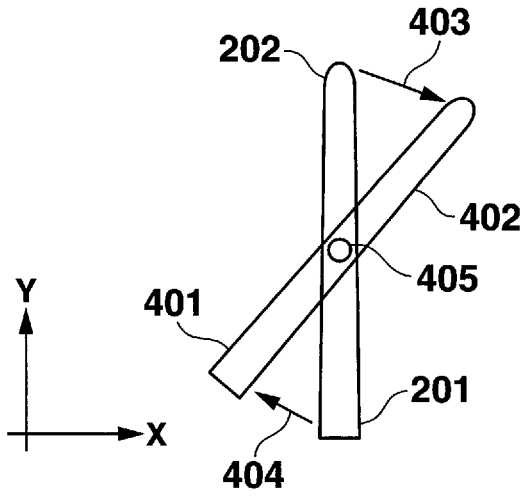
FIGS. 4*a* and 4*b* are views schematically showing movements of the performance apparatus swung by the player in the first embodiment of the invention.
Figure 4B:
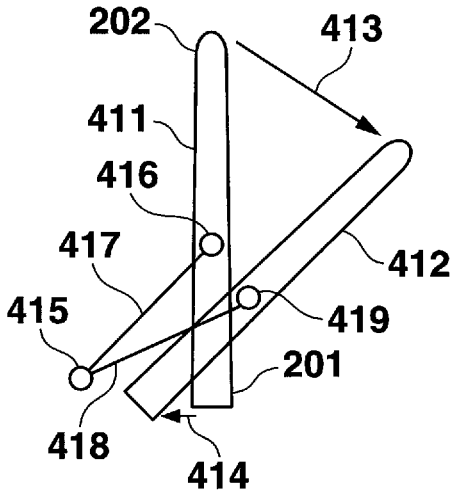

FIGS. 4*a* and 4*b* are views for explaining the fourth operation mode. FIG. 4*a* is a view showing a rotational movement of the performance apparatus 11, wherein the player holds around the middle of the performance apparatus 11 and turns his or her wrist to rotate the performance apparatus 11. As shown in FIG. 4*a*, the performance apparatus 11 is initially held at a position 401 and then moved finally to a position 402. A vector 403 represents a displacement of the head 202 and a vector 404 represents a displacement of the base 201 of the performance apparatus 11. A reference number 405 denotes a node point corresponding to a position of the wrist of the player. In the case, the performance apparatus 11 rotates about the node point 314 at the middle of the performance apparatus 11. This operation mode has the feature that the vectors 403 and 404 have the opposite direction to each other.

FIG. 4*b* is a view showing a rotational movement of the performance apparatus 11, wherein the player holds around the middle of the performance apparatus 11 and turns his or her wrist with the fulcrum at his or her elbow to rotate the performance apparatus 11. As shown in FIG. 4*b*, the performance apparatus 11 is initially held at a position 411 and then moved finally to a position 412. A vector 413 represents a displacement of the head 202 and a vector 414 represents a displacement of the base 201 of the performance apparatus 11. A reference number 415 indicates the elbow of the player as the node point and reference numbers 417, 418 indicate the arms of the player as links. Reference numbers 416, 419 indicate the wrist of the player as the node point. In this case, the performance apparatus 11 rotates with node points of the elbow and wrist of the player and with the links of the arm of the player as shown in FIG. 4*b*. The operation mode has the feature that the vectors 413 and 414 have the opposite direction to each other.

In the first embodiment, it is judged depending on the orientation and magnitude of the vector in the X-axis, in which operation mode the performance apparatus 11 has been operated. This judgment will be described later, again.

In the present embodiment, the acceleration sensors 22, 23 are able to obtain components of the acceleration-sensor values of the base and head of the performance apparatus 11 along the X-axis, Y-axis and Z-axis (in FIG. 5), respectively. CPU 21 combines the components of the acceleration-sensor value along the X-axis, Y-axis and Z-axis to obtain a sensor-combined value. In the case the performance apparatus 11 is kept still, the sensor-combined value obtained by combining the components of the acceleration-sensor value in the X-axis, Y-axis and Z-axis will be equivalent to the gravity acceleration of "1G". Meanwhile, when the performance apparatus 11 is swung by the player, the sensor-combined value will be a value larger than the gravity acceleration of "1G". Therefore, referring to the value of the sensor-combined value, CPU 21 can determine whether a swinging operation of the performance apparatus 11 has started or finished.

As shown in FIG. 2, the performance apparatus 11 comprises CPU 21, the infrared communication device 24, ROM 25, RAM 26, an interface (I/F) 27 and an input unit 28. CPU 21 performs various processes including an obtaining operation of acceleration-sensor values of the performance apparatus 11, a detecting operation of sound-generation timings of musical tones in accordance with the acceleration-sensor values, a determining operation of a tone color of musical tones in accordance with the operation mode, a producing operation of note-on events, and a controlling operation of a sending operation of the note-on events through I/F 27 and the infrared communication device 24.

ROM 25 stores various process programs for obtaining acceleration-sensor values in the performance apparatus 11, detecting of sound-generation timings of musical tones in accordance with the acceleration-sensor values, determining the tone color of musical tones in accordance with the operation mode, producing a note-on event, and controlling a sending operation of the note-on event through I/F 27 and the infrared communication device 24. RAM 26 stores values produced and/or obtained in the process such as acceleration-sensor values, and tone-color tables to be described later, wherein the tone color table associates tone colors with the operation modes. In accordance with an instruction from CPU 21, data is supplied to the infrared communication device 24 through I/F 27. The input unit 28 includes various switches (not shown).

Figure 6:
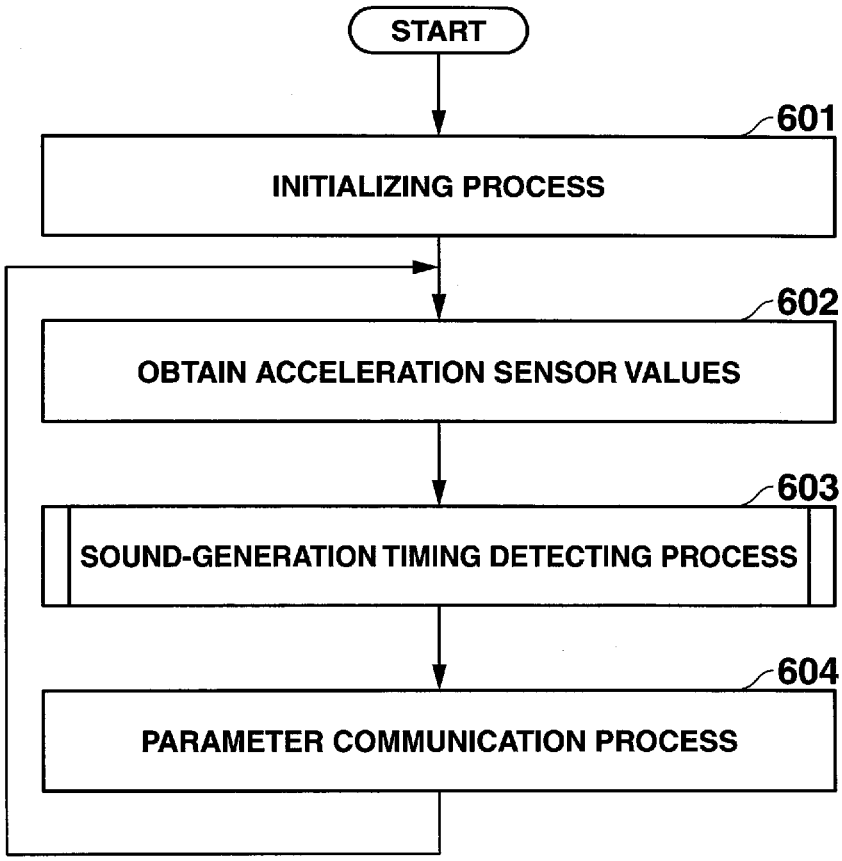
FIG. 6 is a flow chart showing an example of a process performed in the performance apparatus according to the first embodiment of the invention.

FIG. 6 is a flowchart showing an example of a process performed in the performance apparatus 11 according to the first embodiment of the invention. CPU 21 of the performance apparatus 11 performs an initializing process at step 601, clearing data in RAM 26 and resetting an acceleration flag.

After performing the initializing process at step 601, CPU 21 obtains a sensor value (first acceleration-sensor value) of the first acceleration sensor 22 and a sensor value (second acceleration-sensor value) of the second acceleration sensor 23, and stores the obtained sensor values in RAM 26 at step 602. As described above, the acceleration sensors 22, 23 in the present embodiment are the 3-dimensional sensors, and therefore, both the obtained first and second acceleration-sensor value include the components of the acceleration-sensor value in the X-axis, Y-axis and Z-axis, respectively.

Figure 7:
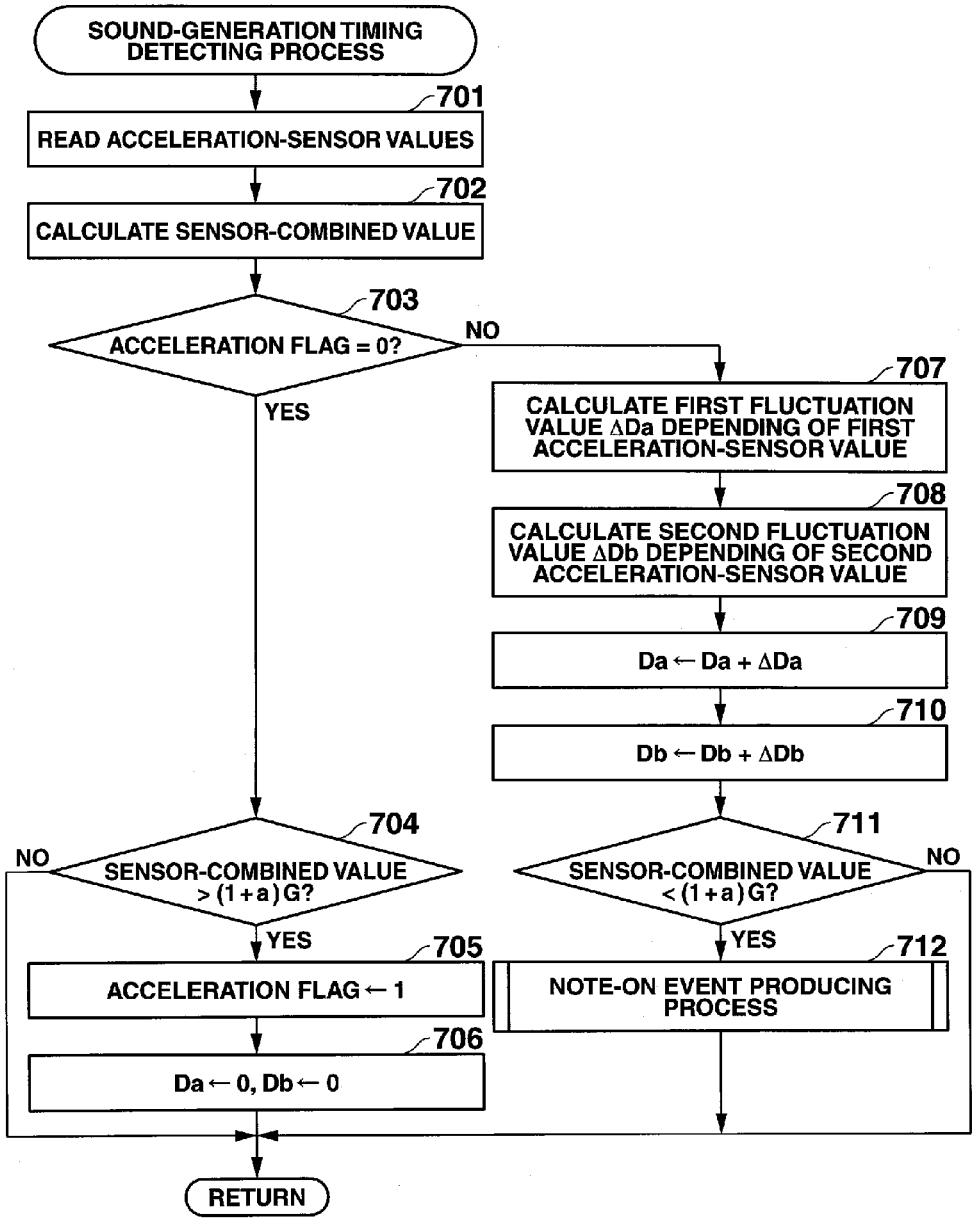
FIG. 7 is a flow chart showing an example of a sound-generation timing detecting process performed in the performance apparatus according to the first embodiment of the invention.

Then, CPU 21 performs a sound-generation timing detecting process at step 603. FIG. 7 is a flow chart showing an example of the sound-generation timing detecting process performed in the performance apparatus 11 according to the first embodiment of the invention. CPU 21 reads the first and the second acceleration-sensor value from RAM 26 at step 701. CPU 21 calculates a sensor-combined value from the components (X1, Y1, and Z1) of the first acceleration-sensor value along the X-axis, Y-axis and Z-axis read from RAM 26 (step 702). The sensor-combined value can be obtained, for example, by finding the square root of the sum of the squares of the components of the acceleration-sensor value along the X-axis, Y-axis and Z-axis.

CPU 21 judges at step 703 whether or not the acceleration flag in RAM 26 has been set to "0". When it is determined YES at step 703, CPU 21 judges at step 704 whether or not the sensor-combined value is larger than a value of (1+a) G, where "a" is a positive fine constant. For example, if "a" is "0.05", CPU 21 judges whether or not the sensor-combined value is larger than a value of 1.05 G. In the case it is determined YES at step 703, this means that the performance apparatus 11 is swung by the player and the sensor-combined value has increased larger than the gravity acceleration of "1G". The value of "a" is not limited to "0.05". On the assumption that "a"=0, it is possible to judge at step 704 whether or not the sensor-combined value is larger than a value corresponding to the gravity acceleration "1G".

When it is determined YES at step 704, CPU 21 sets a value of "1" to the acceleration flag in RAM 26 (step 705). Further, CPU 21 initializes a variation Da of the first acceleration-sensor value in RAM 26 to a value of "0" and a variation Db of the second acceleration-sensor value in RAM 26 to a value of "0" at step 706. When it is determined NO at step 704, then the sound-generation timing detecting process terminates.

When it is determined at step 703 that the acceleration flag in RAM 26 has been set to "1" (NO at step 703), CPU 21 calculates a fluctuation value ΔDa of the first variation Da of the first acceleration-sensor value obtained from the first acceleration sensor 22 (step 707). In the present embodiment, the fluctuation value ΔDa (first fluctuation value) represents a difference with a sign along the X-axis between the first variation Da obtained at the time when the just previous fluctuation value ΔDa is calculated and the first variation Da obtained at the time when the current fluctuation value ΔDa is calculated, wherein the above time difference is expressed by Δt. For instance, the first fluctuation value ΔDa can be calculated from X component (X1) of the first acceleration-sensor value and the above time difference Δt. CPU 21 calculates a fluctuation value ΔDb of the second variation Db depending on the second acceleration-sensor value obtained from the second acceleration sensor 23 (step 708). The second fluctuation value ΔDb represents a difference with a sign along the X-axis between the second variation Db obtained at the time when the just previous fluctuation value ΔDb is calculated and the second variation Db obtained at the time when the current fluctuation value ΔDb is calculated, wherein the above time difference is expressed by Δt.

CPU 21 adds the first fluctuation value ΔDa to the first variation Da stored in RAM 26 (step 709) and adds the second fluctuation value ΔDb to the second variation Db stored in RAM 26 (step 710). Then, CPU 21 judges at step 711 whether or not the sensor-combined value is smaller than the value of (1+a)G. When it is determined that the sensor-combined value is not smaller than the value of (1+a)G (NO at step 711), then the sound-generation timing detecting process terminates. When it is determined YES at step 711, CPU 21 performs a note-on event producing process at step 712.

Figure 8:
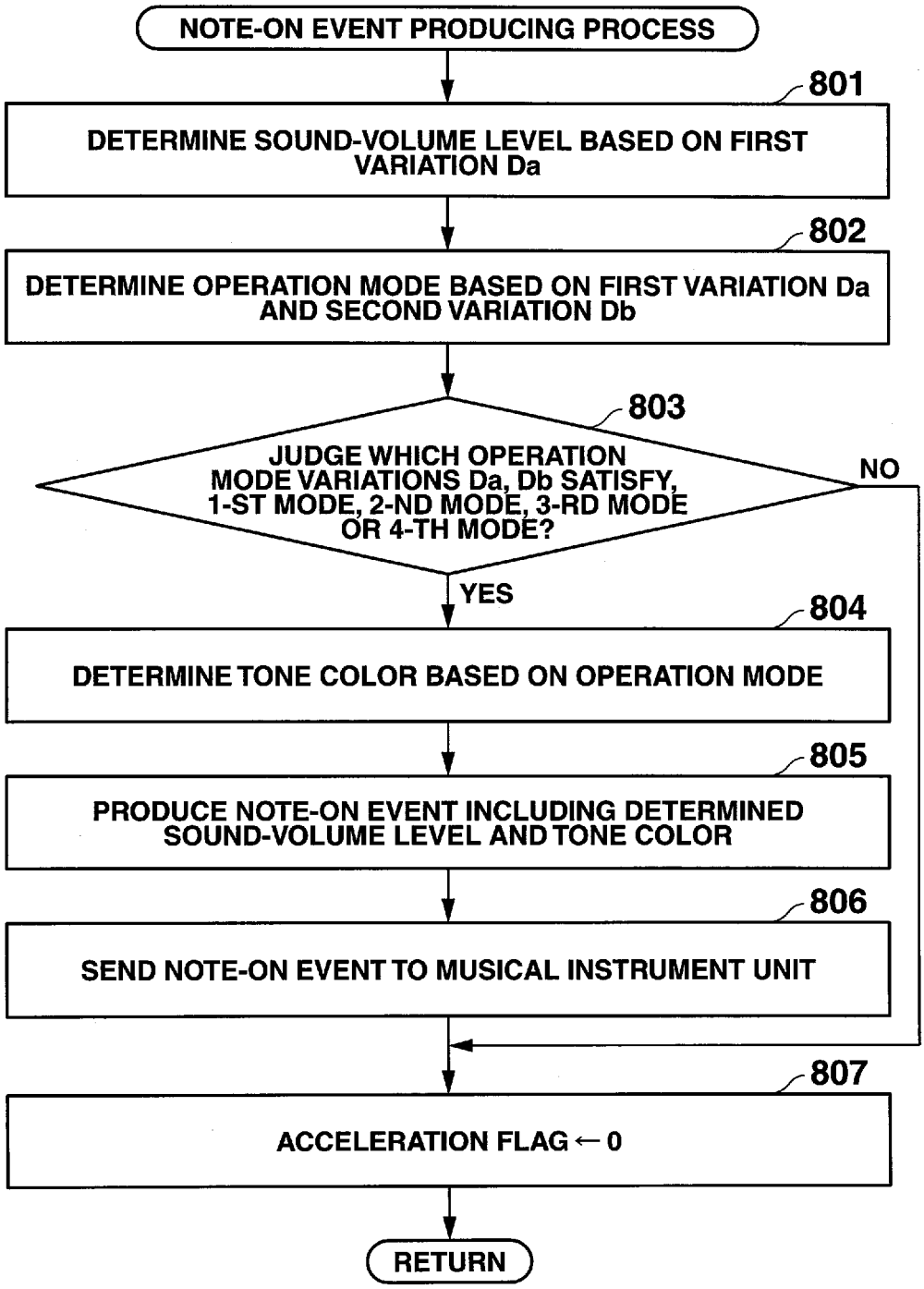
FIG. 8 is a flow chart showing an example of a note-on event producing process performed in the performance apparatus according to the first embodiment of the invention.

FIG. 8 is a flow chart showing an example of the note-on event producing process performed in the performance apparatus 11 according to the present embodiment. In the note-on event producing process shown in FIG. 8, a note-on event is sent from the performance apparatus 11 to the musical instrument unit 19, and then a sound generating process (FIG. 9) is performed in the musical instrument unit 19, whereby musical tone data is generated and a musical tone is output from the speaker 35.

Figure 10:
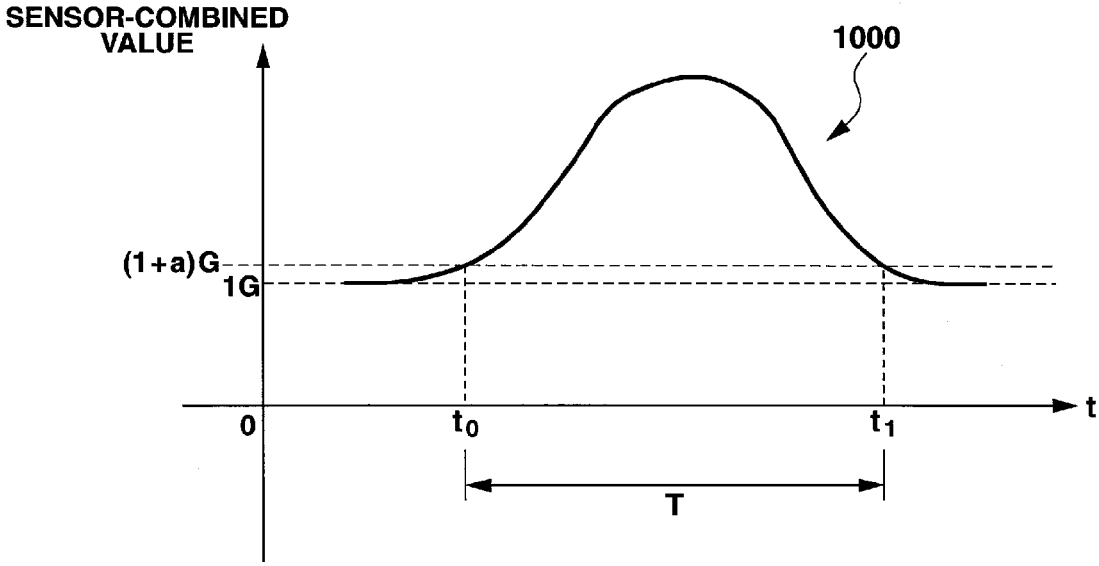
FIG. 10 is a view showing a graph that typically represents an example of a sensor-combined value representing a combined value of components of a first acceleration-sensor value detected by the first acceleration sensor of the performance apparatus.

Before describing the note-on event producing process, the sound-generation timing in the electronic musical instrument 10 of the present embodiment will be described. FIG. 10 is a view showing a graph that typically represents an example of a sensor-combined value representing a combined value of the components of the first acceleration-sensor value detected by the first acceleration sensor 22 of the performance apparatus 11. As shown by a curve 1000 in FIG. 10, when the player keeps the performance apparatus 11 still, the sensor-combined value will measure a value of "1G". When the player swings the performance apparatus 11, the sensor-combined value will increase, and when the player holds the performance apparatus 11 still again after swinging it, then the sensor-combined value will return to the value of "1G".

In the present embodiment, at the time "$t_0$" when the sensor-combined value has increased larger than a value of (1+a) G, where "a" is a positive fine constant, the first variation Da and the second variation Db are initialized to "0" (step 706 in FIG. 7). At the time "$t_1$" when the sensor-combined value has decreased lower than the value of (1+a)G, where "a" is a positive fine value, a note-on event process is performed to generate a musical tone. The note-on event process will be described later. The first variation Da and the second variation Db represent displacements along the X-axis of the base 201 and the head 202 of the performance apparatus 11 appearing in a time period "T" between the time "$t_0$" and the time "$t_1$".

In the note-on event producing process of FIG. 8, CPU 21 refers to the first variation Da stored in RAM 26 to determine a sound-volume level (velocity) of a musical tone in accordance with such first variation Da (step 801). For example, assuming that the maximum value of the sound-volume level (velocity) is denoted by Vmax, then the sound-volume level Vel will be given by the following equation.

$Vel=a\cdot Da$, where if $a\cdot Da>V\max$, $Vel=V\max$, and "$a$" is a positive constant.

Then, CPU 21 judges depending on the first variation Da and the second variation Db, in which operation mode the performance apparatus 11 has been operated (step 802). As described with reference to FIG. 3 and FIG. 4, four operation modes, that is, the first, second, third and fourth operation mode are prepared for the performance apparatus 11 in the present embodiment of the invention. To determined in which operation mode the performance apparatus 11 has been operated, are used the first variation Da, that is, the variation along the X-axis of the first acceleration-sensor value and the second variation Db, that is, the variation along the X-axis of the second acceleration-sensor value.

More specifically, referring to the tone-color table stored in RAM 26, CPU 21 judges whether or not the first variation Da and the second variation Db satisfy any one of the conditions corresponding respectively to the first, second, third, and fourth operation mode. FIG. 11 is a view showing an example of the tone-color table containing the operation modes and conditions corresponding thereto, prepared in the present embodiment. In the tone-color table 1101 shown in FIG. 11, every operation mode, the conditions and the tone colors are associated with each other. In the case (refer to Reference Number: 1103) that the operation of the performance apparatus 11 corresponds to none of the first operation mode to the fourth operation mode, since no musical tone is generated in the present embodiment, it is only necessary to store in RAM 26 the data corresponding to the portion of the reference number 1102.

As shown in FIG. 11, the first variation Da and the second variation Db are required to satisfy the following conditions in the first, second, third and fourth operation mode.

In the first mode, the first variation Da and the second variation Db satisfy the following conditions:

$|Da|>Dth1$, where Dth1 is a first positive threshold value, $|Db|>Dth1$, $|Da-Db|<Dth2$, where Dth2 is a second positive threshold value, which is sufficiently smaller than the first threshold value Dth1, and Da and Db have the same sign.

More specifically, in the case that the absolute values of the variations Da, Db along the X-axis of the head 202 and base 201 of the performance apparatus 11 are larger than the first threshold value and both the variations Da, Db have substantially the same value, that is, in the case that the absolute values of both the variations Da, Db are substantially equivalent and both the variations Da, Db have the same sign, it is determined that the performance apparatus has been operated in the first operation mode.

In the second mode, the first variation Da and the second variation Db satisfy the following conditions:

$|Da|>Dth1$, and $|Db|<Dth2$.

More specifically, in the case that the absolute value of the variation Da along the X-axis of the head 202 of the performance apparatus 11 is larger than the first threshold value and meanwhile the variation Db along the X-axis of the base 201 of the performance apparatus 11 is substantially null, then it is determined that the performance apparatus has been operated in the second operation mode.

In the third mode, the first variation Da and the second variation Db satisfy the following conditions:

$|Da|>Dth1$, $Dth2<|Db|<Dth1$, and Da and Db have the same sign.

More specifically, in the case that the absolute value of the variation Da along the X-axis of the head 202 of the performance apparatus 11 is larger than the first threshold value and the absolute value of the variation Db along the X-axis of the base 201 of the performance apparatus 11 is larger than the second threshold value and smaller than the first threshold value, and both the variations Da, Db have the same sign, then it is determined that the performance apparatus has been operated in the third operation mode.

In the fourth mode, the first variation Da and the second variation Db satisfy the following conditions:

$|Da|>Dth3$, where Dth3 is a third positive threshold value, and $Dth2<Dth3 \leq Dth1$, $|Db|>Dth3$, and Da and Db have the different sign.

More specifically, in the case that the absolute values of the variations Da, Db along the X-axis of the head 202 and base 201 of the performance apparatus 11 are larger than the third threshold value and the variations Da, Db have the different sign, it is determined that the performance apparatus has been operated in the fourth operation mode.

CPU 21 judges at step 803 which one of the four conditions described above the first variation Da and the second variation Db satisfy, wherein the four conditions correspond to the first, second, third, and fourth operation mode, respectively. When it is determined NO at step 803, CPU 21 advances to step 807. Meanwhile, when it is determined YES at step 803, CPU 21 determines a tone color of the musical tone to be generated depending on the operation mode (step 804). As shown in FIG. 11, every operation mode is associated with its specific condition and the tone color in the tone-color table 1101. Therefore, CPU 21 refers to the tone-color table 1101 to specify a tone color (for example, piano, toms, guitar or trumpet) corresponding to the decided operation mode.

Then, CPU 21 produces a note-on event including information representing a tone color and a pitch at step 805. A fixed pitch may be used. CPU 21 sends the produced note-on event to I/F 27 at step 806. I/F 27 makes the infrared communication device 24 send an infrared signal of the note-on event. The infrared signal is transferred from the infrared communication device 24 to the infrared communication device 33 of the musical instrument unit 19. Thereafter, CPU 21 resets the acceleration flag in RAM 26 to "0" at step 807.

When the sound-generation timing detecting process finishes at step 603 in FIG. 6, CPU 21 performs a parameter communication process at step 604. The parameter communication process (step 604) will be described together with a parameter communication process to be performed in the musical instrument unit 19 (step 905 in FIG. 9).

Figure 9:
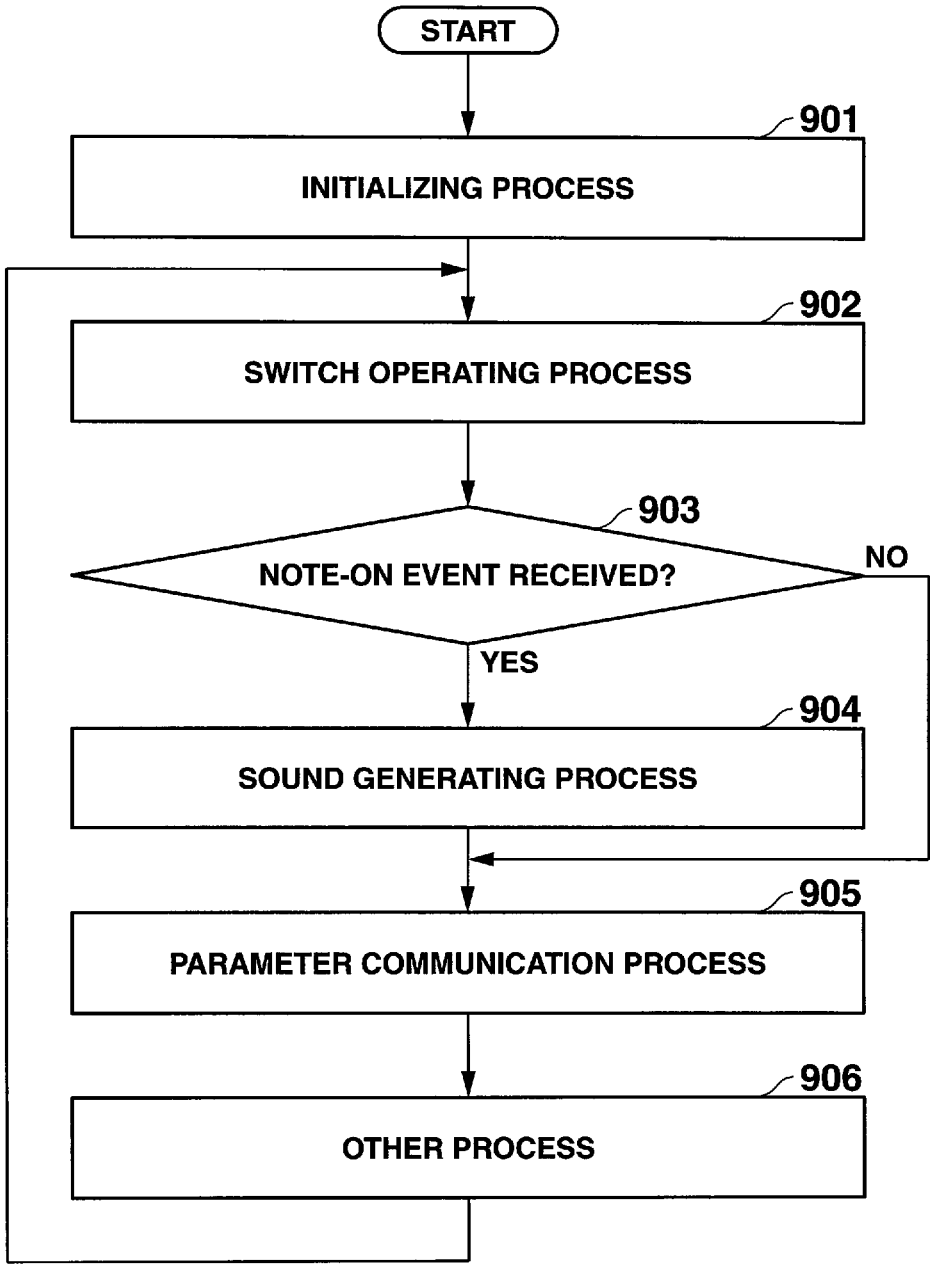
FIG. 9 is a flow chart of an example of a process performed in a musical instrument unit in the first embodiment of the invention.

The process to be performed in the musical instrument unit 19 according to the first embodiment will be described with reference to a flow chart in FIG. 9. The flow chart of FIG. 9 shows an example of the process performed in the musical instrument unit 19 in the first embodiment. CPU 12 of the musical instrument unit 19 performs an initializing process at step 901, clearing data in RAM 15 and an image on the display screen of the displaying unit 16 and further clearing the sound source 31. Then, CPU 12 performs a switch operating process at step 902. In the switch operating process, a predetermined tone-color table is designated from among plural tone-color tables in RAM 15 in response to the switch operation by the player, wherein in each tone-color table, the operation mode, the condition and the tone color are associated with each other.

The present embodiment may be modified so as to allow the player to edit the tone-color table. For example, CPU 21 displays the contents of the table on the display screen of the displaying unit 16, allowing the player to change the tone color of musical tones by operating the switches and ten keys (not shown) in the input unit 17. The table whose contents are changed is stored in RAM 15. An arrangement may be made such that the conditions in the tone-color table are edited.

Then, CPU 12 judges at step 903 whether or not any note-on event has been received through I/F 13. When it is determined at step 903 that a note-on event has been received through I/F 13 (YES at 903), CPU 12 performs the sound generating process at step 904. In the sound generating process, CPU 12 sends the received note-on event to the sound source unit 31. The sound source unit 31 reads waveform data from ROM 14 in accordance with the tone color represented by the note-on event. The waveform data is read at a rate corresponding to the pitch included in the note-on event. The sound source unit 31 multiplies the waveform data by a coefficient corresponding to the sound-volume data (velocity) included in the note-on event, producing musical tone data of a predetermined sound-volume level. The produced musical tone data is supplied to the audio circuit 32, and a musical tone is finally output through the speaker 35.

After the sound generating process has been finished (step 904), CPU 12 performs a parameter communication process at step 905. In the parameter communication process, CPU 12 gives an instruction to the infrared communication device 33, and the infrared communication device 33 sends data of the tone-color table selected in the switch operating process (step 902) to the performance apparatus 11 through I/F 13. In the performance apparatus 11, when the infrared communication device 24 receives the data, CPU 21 stores the data in RAM 26 through I/F 27 (step 604 in FIG. 6).

When the parameter communication process has finished at step 905 in FIG. 9, CPU 12 performs other process at step 906. For instance, CPU 12 updates an image on the display screen of the displaying unit 16.

In the present embodiment, the performance apparatus 11 is provided with the 3-dimensional acceleration sensors 22, 23 at its head and base, respectively. The first variation Da appearing in a period between the first timing and the second timing is calculated from the first acceleration-sensor value obtained by the first acceleration sensor 22, and the second variation Db appearing in the period between the first timing and the second timing is calculated from the second acceleration-sensor value obtained by the second acceleration sensor 23, wherein the first timing corresponds to the time at which the player starts swinging motion of the performance apparatus 11 and the second timing corresponds to the time at which the player finishes the swinging motion of the performance apparatus 11. CPU 21 judges the way in which the performance apparatus 11 is moved or swung by the player, depending on the first and second variations Da and Db, thereby deciding the operation mode and a musical-tone composing element (for example, a tone color) of a musical tone to be generated. Therefore, the player is allowed to decide a musical-tone composing element (tone color) of musical tones to be generated by changing the way of swinging or moving the performance apparatus 11 and to generate musical tones of the decided tone color.

In the present embodiment, CPU 21 calculates the first variation Da of the head 202 of the performance apparatus 11 in the period from a first timing to a second timing, depending on the first acceleration-sensor value and the second variation Db of the base 201 of the performance apparatus 11 in the period from the first timing to the second timing, depending on the second acceleration-sensor value, and determines the operation mode of the performance apparatus 11 depending on the calculated first and second variations Da, Db. CPU 21 can properly obtain displacements of the base and the head of the performance apparatus 11 using the sensor values of the acceleration sensors 22, 23 provided at both ends of the performance apparatus 11.

In the present embodiment, CPU 21 calculates the first variation Da from the first acceleration-sensor value component in the direction perpendicular to the axis in the longitudinal direction of the performance apparatus 11, obtained by the first acceleration sensor 22 and the second variation Db from the second acceleration-sensor value component in the direction perpendicular to the axis in the longitudinal direction of the performance apparatus 11, obtained by the second acceleration sensor 23, whereby CPU 21 can properly obtain displacements of the head and base of the performance apparatus 11 without executing complex operations.

In the present embodiment, CPU 21 judges which operation mode the operation of the performance apparatus 11 satisfies, the first operation mode, second operation mode, third operation mode or fourth operation mode, wherein the first operation mode meets the conditions that both the absolute values of the first variation and the second variation are larger than the first threshold value, the absolute value of a difference between the first variation and the second variation is smaller than the second threshold value, wherein the second threshold value is smaller than the first threshold value, and the first variation and the second variation have the same sign, and the second operation mode meets the conditions that the absolute value of the first variation is larger than the first threshold value and the absolute value of the second variation is smaller than the second threshold value, and the third operation mode meets the conditions that the absolute value of the first variation is larger than the first threshold value and the absolute value of the second variation falls into a range from the second threshold value to the first threshold value, and the first variation and the second variation have the same sign, and the fourth operation mode meets the conditions that both the absolute values of the first variation and the second variation are larger than the third threshold value and the first variation and the second variation have the different sign from each other.

Depending on the operation mode of the performance apparatus 11, CPU 21 can properly determines the movement of the performance apparatus 11 out of the following movements: a parallel or side movement of the performance apparatus 11 with the base held by the player (first operation mode), a rotating movement of the performance apparatus 11 about the center at the player's wrist with the base held by the player (second operation mode), a rotating movement of the performance apparatus 11 about the center at the player's elbow or wrist with the base held by the player (third operation mode), and a rotating movement of the performance apparatus 11 with the middle portion held by the player (fourth operation mode).

In the present embodiment, when the sensor-combined value of the first acceleration-sensor value or the sensor-combined value of the second acceleration-sensor value has increased larger than a predetermined value, CPU 21 determines that the performance apparatus 11 starts its motion (first timing), and when the sensor-combined value has decreased smaller than a predetermined value after once increasing, CPU 21 determines that the performance apparatus 11 stops its motion (second timing). From the first timing and the second timing, a time period can be calculated, between the time when the performance apparatus 11 starts its motion and the time when the performance apparatus 11 stops its motion.

In the present embodiment, referring to the tone-color table stored in RAM 26, CPU 21 determines a tone color of a musical tone to be generated, wherein the tone-color table associates the operation modes with tone colors of musical tones to be generated. In this way, CPU 21 can be properly determine the tone color of a musical tone to be generated without executing complex operations.

Now, the second embodiment of the invention will be described. A performance apparatus in the second embodiment is further provided with a geomagnetic sensor in addition to the acceleration sensors 22, 23. Pitches of musical tones are adjusted based on sensor values obtained by the geomagnetic sensor.

Figure 12:
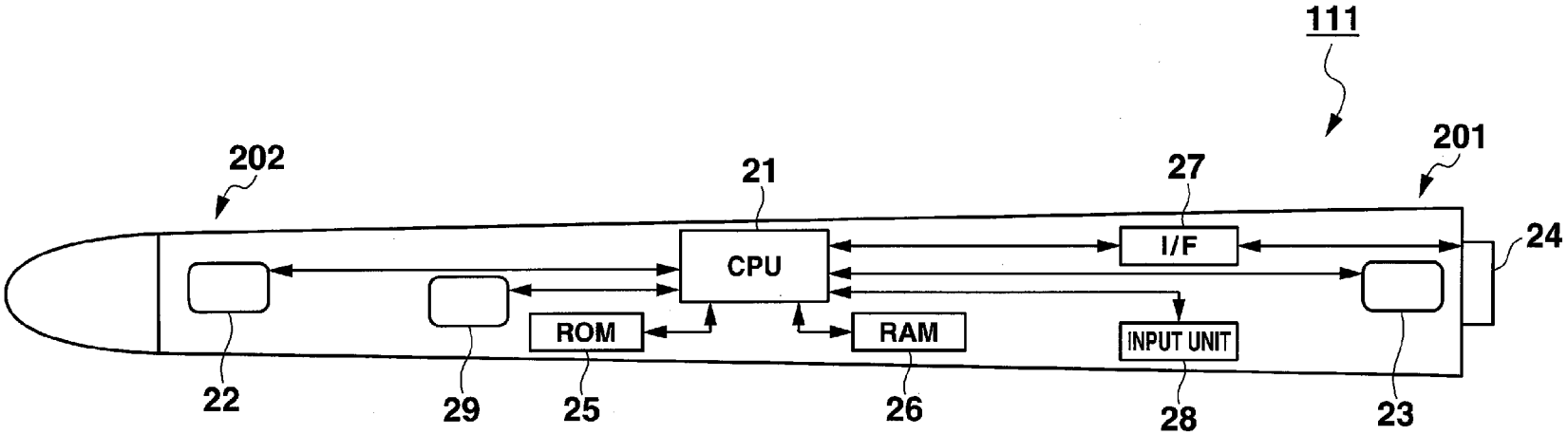
FIG. 12 is a block diagram of a configuration of the performance apparatus in the second embodiment of the invention.

FIG. 12 is a block diagram of a configuration of the performance apparatus in the second embodiment of the invention. In FIG. 12, like parts as those in the first embodiment shown in FIG. 2 are designated by like reference numerals, and their description will be omitted. As shown in FIG. 12, the performance apparatus 111 in the second embodiment has the geomagnetic sensor 29 in addition to the composing elements of the performance apparatus 11 in the first embodiment. The geomagnetic sensor 29 may be installed close to the head 202 or the base 201, or at the middle part of the performance apparatus 111. The geomagnetic sensor 29 has a piezoresistive device or a hole device, and is able to detect a magnetic sensor value containing magnetic-sensor components respectively along the X-axis, Y-axis and Z-axis. The components in the X-axis, Y-axis and Z-axis are the same as those shown in FIG. 5.

Figure 13:
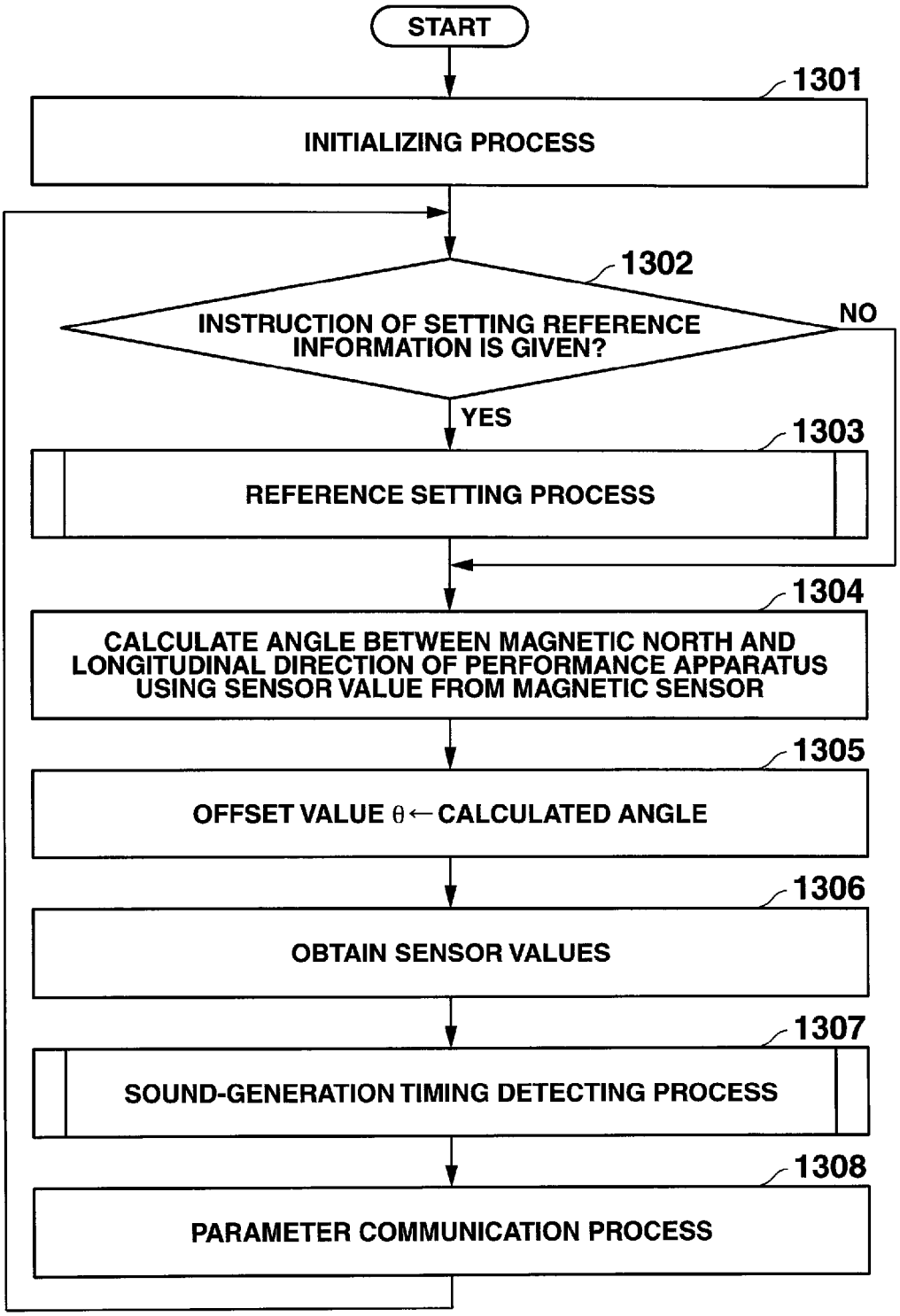
FIG. 13 is a flow chart of an example of a process performed in the performance apparatus according to the second embodiment of the invention.

FIG. 13 is a flow chart of an example of a process to be performed in the performance apparatus 111 according to the second embodiment. CPU 21 of the performance apparatus 111 performs an initializing process at step 1301, clearing data in RAM 26. CPU 21 judges at step 1302 whether or not the switch in the input unit 28 has been operated to give an instruction of setting reference information. When it is determined YES at step 1302, CPU 21 performs a reference setting process at step 1303.

Figure 14:
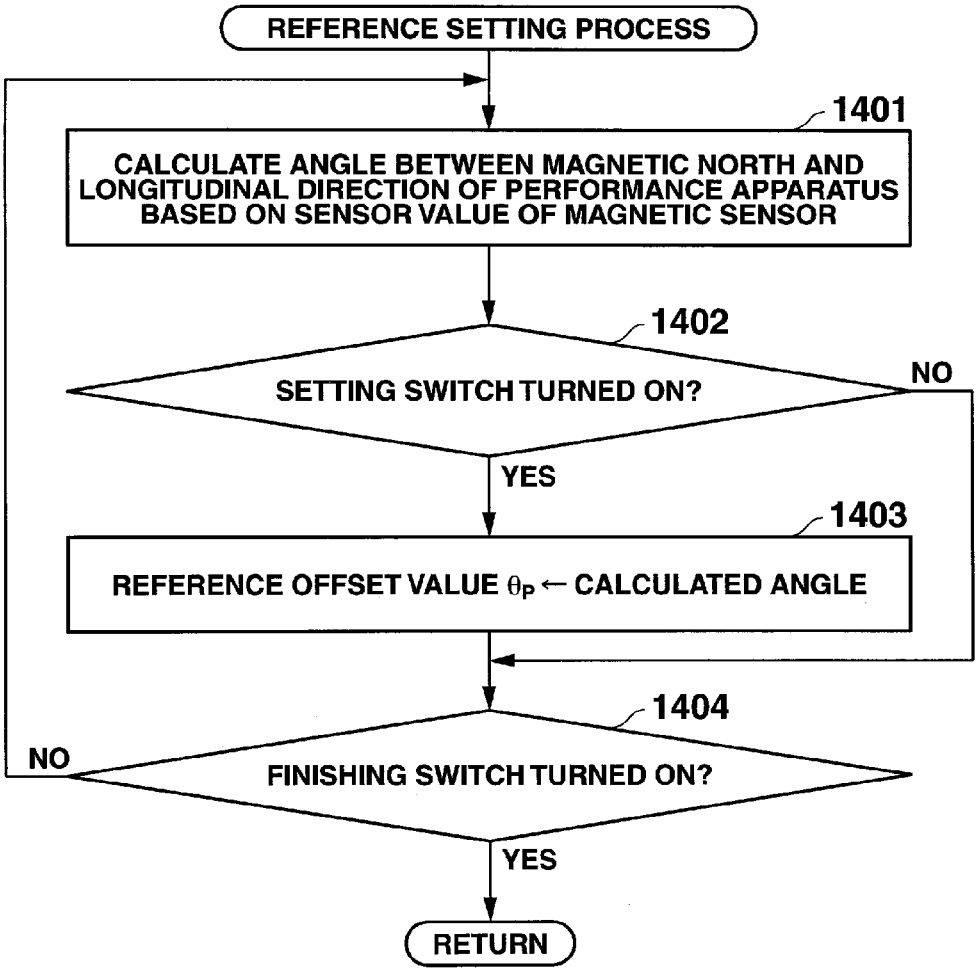
FIG. 14 is a flow chart of an example of a reference setting process performed in the performance apparatus according to the second embodiment of the invention.

FIG. 14 is a flow chart of an example of the reference setting process performed in the performance apparatus 111 according to the second embodiment. In the reference setting process, as the reference value (reference-offset value) is set or obtained the longitudinal direction of the performance apparatus 111 held at the time when the player turns on a setting switch (not shown) of the input unit 28 of the performance apparatus 111. CPU 21 obtains a sensor value of the geomagnetic sensor 29. Using the obtained sensor value of the geomagnetic sensor 29, CPU 21 calculates an angle (discrepancy angle) between the magnetic north (the direction in which the north end of a compass needle will point) and the Y-axis (longitudinal direction) of the performance apparatus 111 (step 1401).

CPU 21 judges at step 1402, whether or not the setting switch of the input unit 28 has been turned on. When it is determined YES at step 1402, CPU 21 stores in RAM 26 the discrepancy angle as the reference-offset value θp (step 1403). Then, CPU 21 judges at step 1404 whether or not a finishing switch (not shown) of the input unit 28 has been turned on. When it is determined NO at step 1404, CPU 21 returns to step 1401. Meanwhile, when it is determined YES at step 1404, CPU 21 finishes the reference setting process. In the above reference setting process, the reference-offset value θp is stored in RAM 26.

When the reference setting process finishes in the performance apparatus 111 at step 1303 in FIG. 13, CPU 21 obtains the sensor value of the geomagnetic sensor 29 to calculate a current discrepancy angle between the magnetic north (the direction in which the north end of a compass needle will point) and the longitudinal direction of the performance apparatus 111 currently held by the player (step 1304). CPU 21 stores in RAM 26 the current discrepancy angle calculated at step 1304 as an offset value θ (step 1305). CPU 21 obtains a sensor value (first sensor value) of the first acceleration sensor 22 and a sensor value (second sensor value) of the second acceleration sensor 23, and stores the obtained sensor values in RAM 26 at step 1306. Like the sensor values in the first embodiment, both the first sensor value and the second sensor value in the second embodiment contain components along the X-axis, Y-axis and Z-axis.

Figure 15:
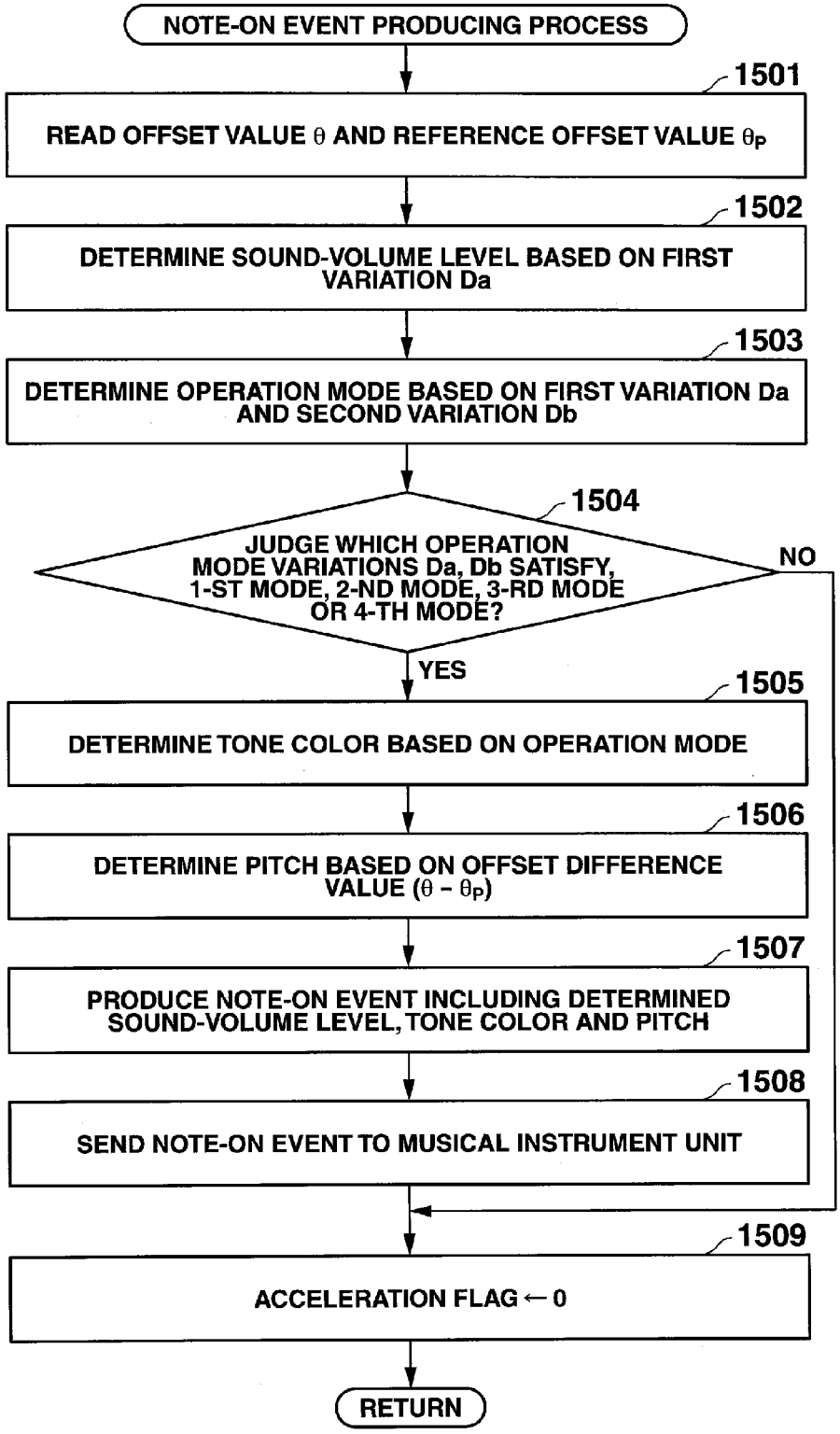
FIG. 15 is a flowchart showing an example of the note-on event producing process performed in the second embodiment of the invention.

After the process at step 1306, CPU 21 performs the sound-generation timing detecting process at step 1307. The sound-generation timing detecting process at step 1307 is substantially the same as the sound-generation timing detecting process (FIG. 7) performed in the first embodiment except the note-on event process of step 712. FIG. 15 is a flow chart showing an example of the note-on event producing process to be performed in the second embodiment of the invention. CPU 21 reads the offset value θ and the reference-offset value θp from RAM 21 (step 1501).

The processes at step 1502 to step 1505 are substantially the same as the processes at step 801 to step 804 in FIG. 8. After the tone color of a musical tone to be generated has been determined at step 1505, CPU 21 calculates a difference value θd in offset between the offset value θ and the reference-offset value θp (θd=θ−θp), and determines a pitch of the musical tone to be generated, based on the calculated difference value θd (step 1506).

Figure 16A:
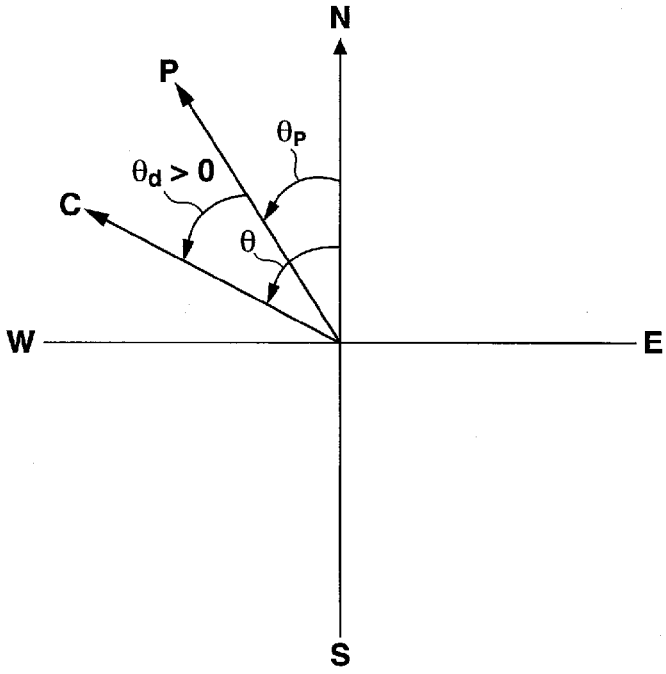
FIG. 16*a* and FIG. 16*b* are views for explaining a difference value θd in the second embodiment of the invention.
Figure 16B:
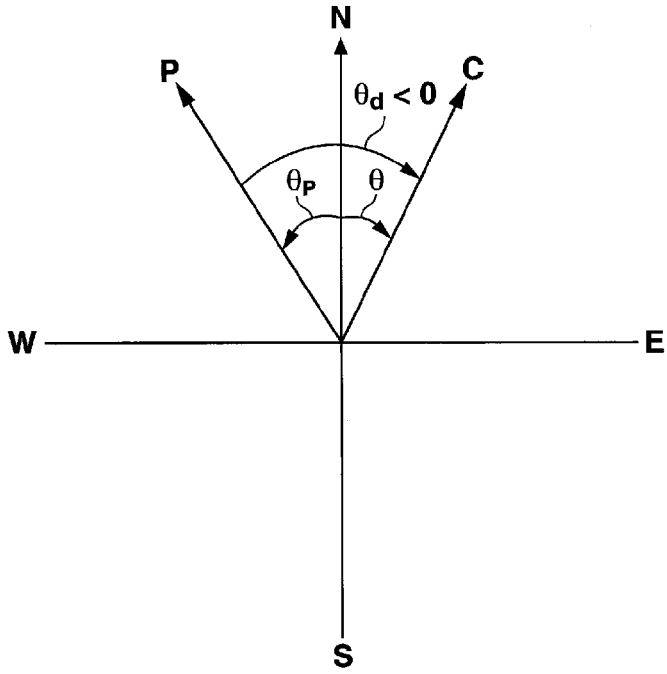

FIG. 16*a* and FIG. 16*b* are views for explaining the difference value θd in the second embodiment of the invention. Assuming that a reference direction (Reference symbol: P) is given by the longitudinal direction of the performance apparatus 111 which is held by the player at the time when the setting switch has been turned on by him or her and a direction (Reference symbol: C) is given by the longitudinal direction of the performance apparatus 111 which is held by the player at the time when the performance apparatus 111 has been swung by him or her, the case is shown in FIG. 16*a*, in which a difference value θd between the reference direction "P" and the direction "C" is positive, and the case is shown in FIG. 16*b*, in which the difference value θd between the reference direction "P" and the direction "C" is negative. When the player swings the performance apparatus 111 on the left side of the reference direction "P", the difference value θd will be positive and on the contrary, when the player swings the performance apparatus 111 on the right side of the reference direction "P", the difference value θd will be negative.

Figures 17A, 17B:
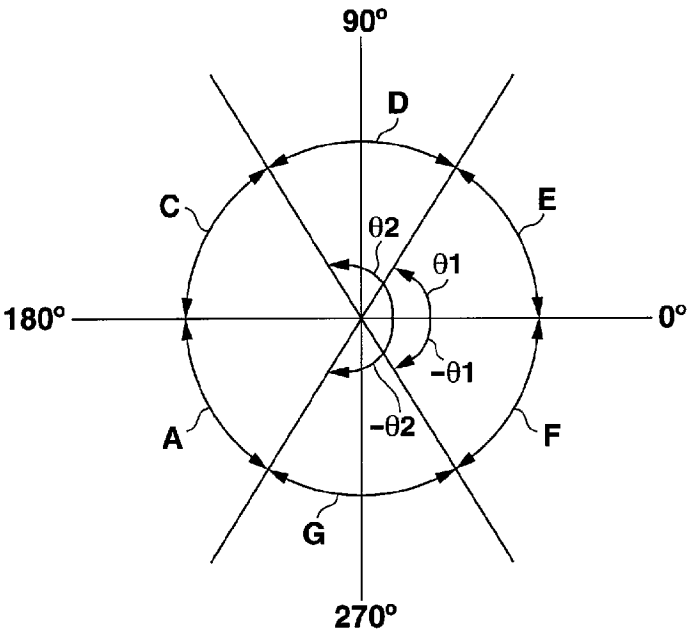
FIG. 17*a* is a view showing an example of a pitch table, which associates ranges of the difference values θd with pitches of musical tones.
FIG. 17*b* is a view schematically showing a relationship between the pitches and directions, in which the performance apparatus is swung.

Hereinafter, generation of musical tones of pitches such as C (Do), D (Re), and E (Mi) will be described. FIG. 17*a* is a view showing an example of a pitch table, which associates ranges of the difference values θd with the pitches of musical tones. FIG. 17*b* is a view schematically showing a relationship between the pitches and directions, in which the performance apparatus 111 is swung. The pitch table shown in FIG. 17*a* is stored in RAM 26 of the performance apparatus 111. As indicated in the pitch table shown in FIG. 17*a*, it will be understood that as the direction, in which the performance apparatus 111 is swung, moves in the clockwise direction, the pitch of the musical tone will go high, such as C (Do), D (Re), E (Mi), F (Fa) and so on. CPU 21 refers to the pitch table 1700 in RAM 26, reading pitch information corresponding to the difference value $\theta_K$d.

In the musical instruments such as pianos, marimbas and vibraphones, pitches of the these musical instruments go high as the keys of the keyboard go rightwards. In the case that musical tones having a tone color of a general keyboard instrument are generated, the pitch of the performance apparatus 111 is set to increase higher as the direction, in which the performance apparatus 111 is swung, moves in the clockwise direction. Meanwhile, in the case that musical tones having tone colors of toms (Hi-tom, Low tom and Floor tom) of a drum set are generated, the toms (Hi-tom, Low tom and Floor tom) of the drum set are arranged in order of pitch around a single player in the clockwise direction. For example, the toms are arranged in the order of Hi-tom, Low tom and Floor tom and in the clockwise direction. Therefore, in the case musical tones of tone colors of percussion instruments are generated, the values contained in the tone-color table in RAM 26 are edited and stored such that the pitch of the performance apparatus 111 will decrease lower as the direction of the longitudinal axis of the performance apparatus 111 to be swung moves in the clockwise direction.

Then, CPU 21 produces a note-on event at step 1507 in FIG. 15, which contains information representing the tone color decided at step 1505 and the pitch decided at step 1506. CPU 21 sends an infrared signal of the note-on event to the infrared communication device 24 through I/F 27 (step 1508). The infrared signal is transmitted from the infrared communication device 24 to the infrared communication device 33 of the musical instrument unit 19. Thereafter, CPU 21 resets the acceleration flag in RAM 26 to "0" (step 1509).

In the second embodiment, using the geomagnetic sensor 29 in addition to the acceleration sensors 22 and 23, CPU 21 calculates the difference value representing the angle between the predetermined reference direction and the longitudinal direction of the performance apparatus 111. For example, CPU 21 calculates the difference value representing the angle between the reference direction and the longitudinal direction of the performance apparatus 111 which is held by the player at the time when the player has finished the swinging motion of the performance apparatus 111. CPU 21 determines other musical-tone composing elements (for example, pitches) based on the calculated difference value. In this way, the player can change plural sorts of musical-tone composing elements (for example, pitches and tone colors) as he or she desires.

Figure 18:
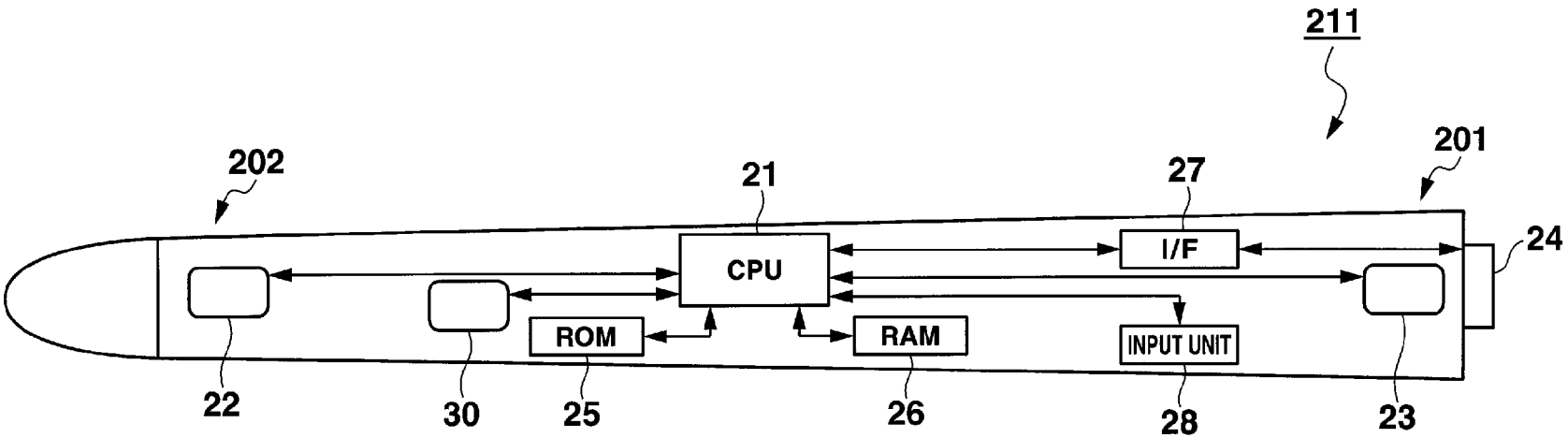
FIG. 18 is a block diagram of a configuration of the performance apparatus in the third embodiment of the invention.
Figure 19:
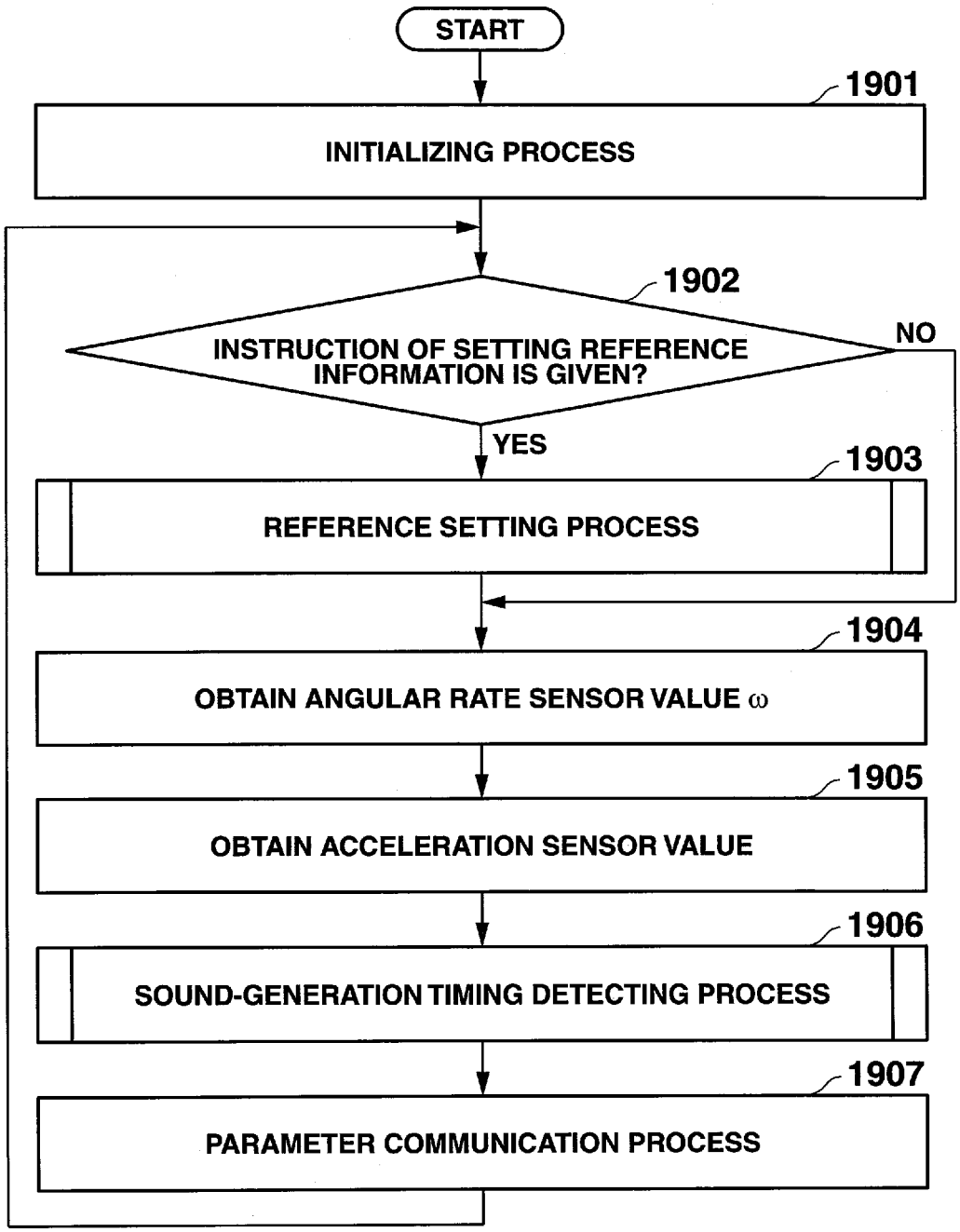
FIG. 19 is a flow chart of an example of a process performed in the performance apparatus in the third embodiment of the invention.

Now, the third embodiment of the invention will be described. In the third embodiment of the invention, an angular rate sensor is used in place of the geomagnetic sensor in the second embodiment, and the pitches of musical tones to be generated are adjusted based on an angular-rate sensor value obtained by the angular rate sensor. FIG. 18 is a block diagram of a configuration of the performance apparatus in the third embodiment of the invention. In FIG. 18, like parts as those in the first embodiment shown in FIG. 2 are designated by like reference numerals, and their description will be omitted. As shown in FIG. 18, the performance apparatus 211 in the third embodiment has the angular rate sensor 30 in addition to the composing elements of the performance apparatus 11 in the first embodiment. The angular rate sensor 30 is a sensor provided with a so-called gyroscope and is able to integrate time information, thereby calculating a displacement (angle) of the performance apparatus 211 in its longitudinal direction (the Y-axis direction). FIG. 19 is a flow chart of an example of a process to be performed in the performance apparatus 211 according to the third embodiment of the invention.

CPU 21 of the performance apparatus 211 performs an initializing process at step 1901, clearing data in RAM 26. CPU 21 judges at step 1902 whether or not the switch (not shown) in the input unit 28 has been operated to give an instruction of setting reference information. When it is determined YES at step 1902, CPU 21 performs a reference setting process at step 1903.

Figure 20:
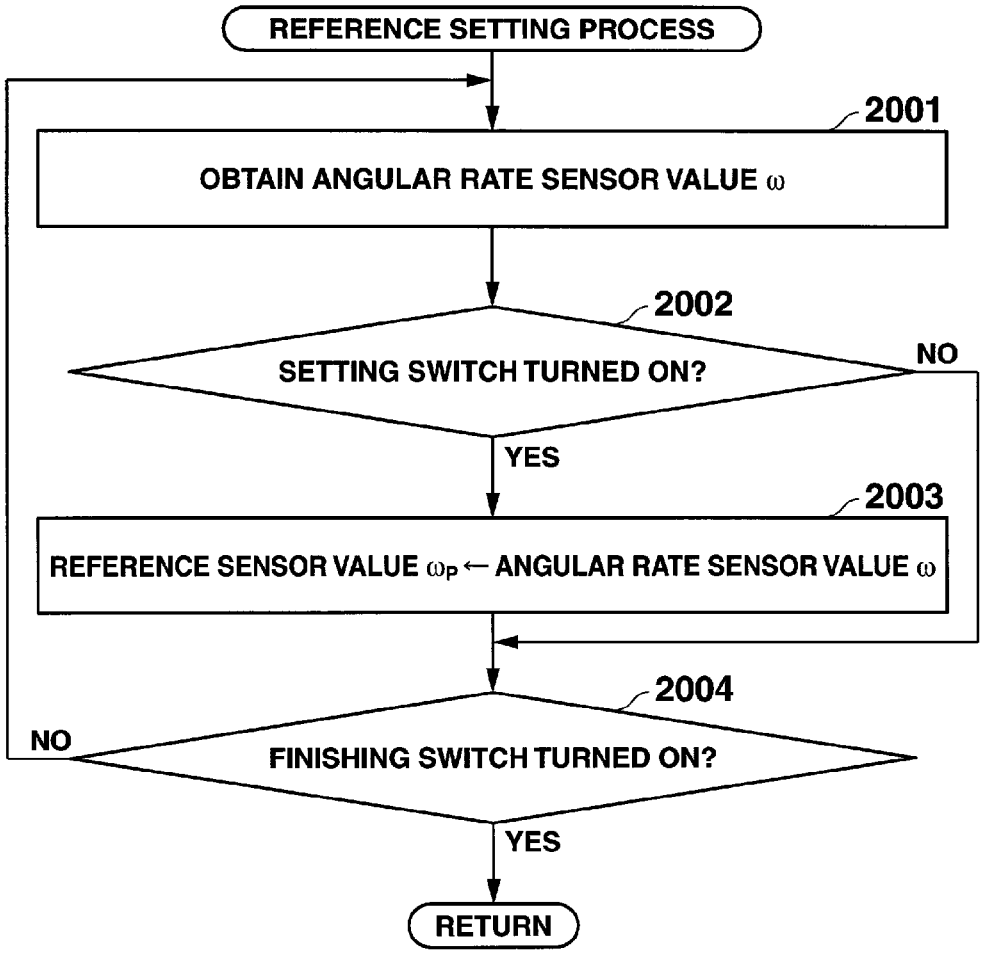
FIG. 20 is a flow chart of an example of the reference setting process performed in the performance apparatus according to the third embodiment of the invention.

FIG. 20 is a flowchart of an example of the reference setting process performed in the performance apparatus 211 according to the third embodiment. In the reference setting process, an angular-rate sensor value is obtained at the time when the player turns on the setting switch (not shown) in the input unit 28 of the performance apparatus 211. More specifically, CPU 21 obtains a sensor value from the angular-rate sensor 30 at step 2001.

CPU 21 judges at step 2002, whether or not the setting switch of the input unit 28 has been turned on. When it is determined YES at step 2002, CPU 21 stores in RAM 26 the angular-rate sensor value as the reference sensor value ωp (step 2003). Then, CPU 21 judges at step 2004 whether or not the finishing switch (not shown) of the input unit 28 has been turned on. When it is determined NO at step 2004, CPU 21 returns to step 2001. Meanwhile, when it is determined YES at step 2004, CPU 21 finishes the reference setting process. In the above reference setting process, the reference sensor value ωp is stored in RAM 26.

When the reference setting process finishes in the performance apparatus 211 at step 1903 in FIG. 19, CPU 21 obtains the sensor value ω from the angular rate sensor 30 and stores the sensor value ω in RAM 26 (step 1904). Further, CPU 21 obtains a sensor value (first sensor value) from the first acceleration sensor 22 and a sensor value (second sensor value) from the second acceleration sensor 23, and stores the obtained sensor values in RAM 26 at step 1905. Like the sensor values in the first and the second embodiment, both the first sensor value and the second sensor value in the third embodiment contain components along the X-axis, Y-axis and Z-axis.

Figure 21:
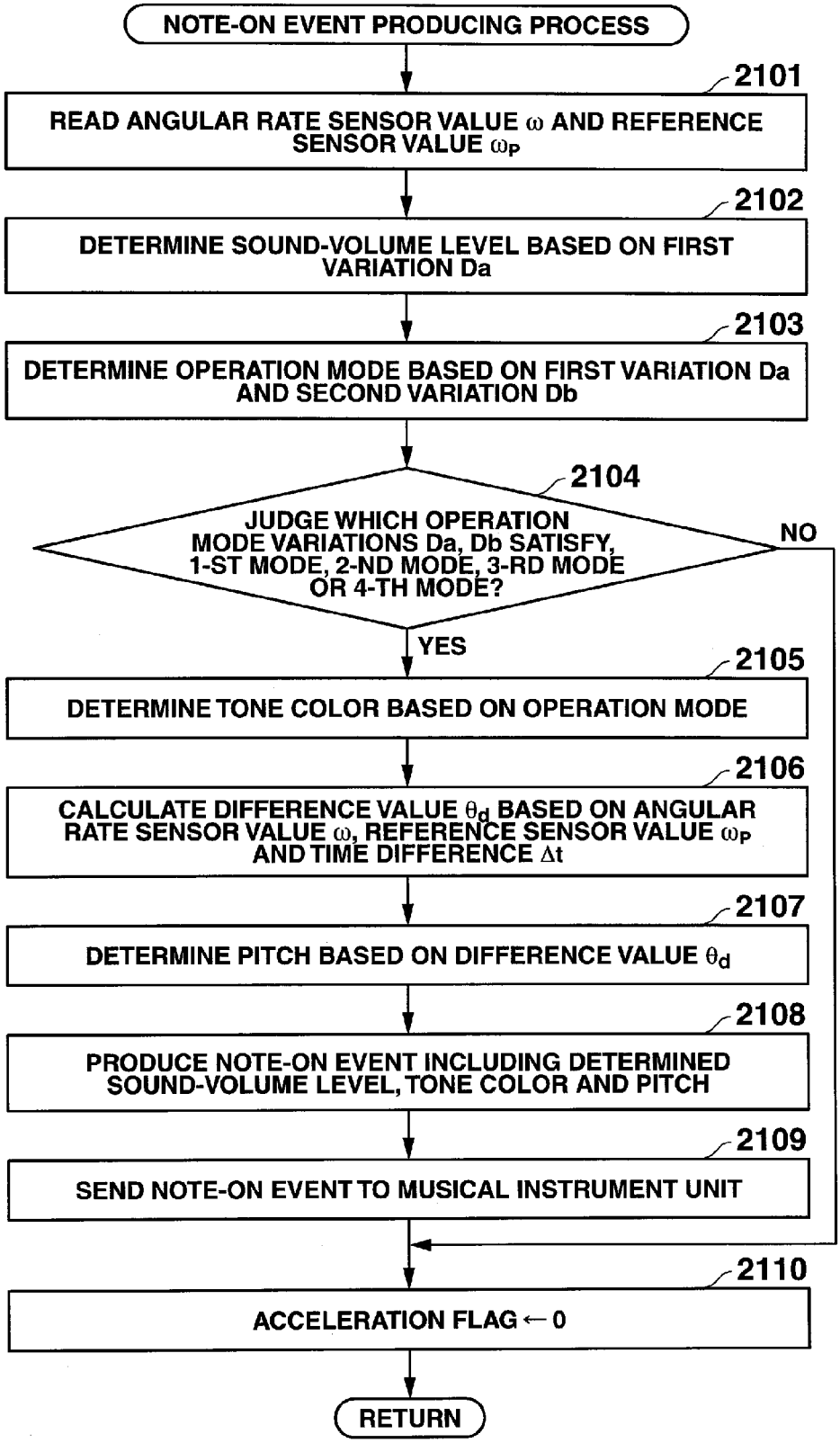
FIG. 21 is a flowchart showing an example of the note-on event producing process performed in the third embodiment of the invention.

After the process at step 1905, CPU 21 performs the sound-generation timing detecting process at step 1906. The sound-generation timing detecting process at step 1906 is substantially the same as the sound-generation timing detecting process (FIG. 7) performed in the first embodiment. But in the third embodiment, CPU 21 sets the acceleration flag to "1" and stores in RAM 26 a time "t", at which the process is performed (step 705). The note-on event producing process in the third embodiment is different from the process of step 712 in FIG. 7 in the first embodiment. FIG. 21 is a flow chart showing an example of the note-on event producing process to be performed in the third embodiment of the invention. CPU 21 reads the angular rate sensor value ω and the reference sensor value ωp from RAM 21 (step 2101).

The processes at step 2102 to step 2105 are substantially the same as those at step 801 to step 804 in FIG. 8. After the tone color of a musical tone to be generated has been determined at step 2105, CPU 21 calculates a displacement (angle) of the performance apparatus 211 in direction of the Y-axis based on the angular rate sensor value ω, the reference sensor value ωp, and a time difference Δt (operating time of the performance apparatus 211) between the time "t" stored in RAM 26 and the present time (step 2106). In the process at step 2106, a difference in angle or a difference value θd is calculated, between the longitudinal direction of the performance apparatus 211 held at the time when the reference sensor value ωp has been obtained based on the instruction of setting the reference information and the longitudinal direction of the performance apparatus 211 held at the time when the swinging motion of the performance apparatus 211 has finished. Then, CPU 21 determines a pitch of a musical tone to be generated, based on the calculated difference value θd (step 2107).

The pitch of a musical tone is determined at step 2107 in substantially the same fashion as in the process of determining the pitch of a musical tone at step 1506 in FIG. 15. Then, CPU 21 produces a note-on event containing information representing the sound volume level (velocity) decided at step 2102, the tone color decided at step 2105, and the pitch decided at step 2107 (step 2108). CPU 21 sends the produced note-on event to the infrared communication device 24 through I/F 27 (step 2109). An infrared signal of the note-on event is transferred from the infrared communication device 24 to the infrared communication device 33 of the musical instrument unit 19. Thereafter, CPU 21 resets the acceleration flag in RAM 26 to "0" (step 2110).

In the third embodiment, using the angular-rate sensor 30 as well as the acceleration sensors 22, 23, CPU 21 calculates a difference value representing an angle between the predetermined reference direction and the longitudinal direction of the performance apparatus 211. For example, CPU 21 calculates the difference value representing the angle between the reference direction and the longitudinal direction of the performance apparatus 211 held at the time when the player has finished the swinging motion of the performance apparatus 211. CPU 21 determines other musical-tone composing elements (for example, pitches) based on the calculated difference value. In this way, the player is allowed to change plural sorts of musical-tone composing elements (for example, pitches and tone colors) as he or she desires.

The present invention has been described with reference to the accompanying drawings and the first to the third embodiment, but it will be understood that the invention is not limited to these particular embodiments described herein, and numerous arrangements, modifications, and substitutions may be made to the embodiments of the invention described herein without departing from the scope of the invention.

In the embodiments, CPU 21 of the performance apparatus 11 detects acceleration-sensor values caused when the player swings the performance apparatus 11, and determines the timing of sound generation. Further, CPU 21 of the performance apparatus 11 detects displacements of the head and the base of the performance apparatus 11, and determines a tone color of a musical tone to be generated based on the detected displacements. Thereafter, CPU 21 of the performance apparatus 11 produces the note-on event including a sound-volume level and a tone color at the timing of sound generation, and transmits the note-on event to the musical instrument unit 19 through I/F 27 and the infrared communication device 24. Meanwhile, receiving the note-on event, CPU 12 of the musical instrument unit 19 supplies the received note-on event to the sound source unit 31, thereby generating a musical tone. The above arrangement is suitable for the case that the musical instrument unit 19 is a device not specialized in generating musical tones, such as personal computers and game machines provided with a MIDI board.

The processes to be performed in the performance apparatus 11 and the processes to be performed in the musical instrument unit 19 are not limited to those described in the above embodiments. For example, an arrangement that obtains the acceleration sensor values and sends them to the musical instrument unit 19 may be made to the performance apparatus 11. In the arrangement, the sound generation timing detecting process (FIG. 7) and the note-on event producing process (FIG. 8) are performed in the musical instrument unit 19. The arrangement is suitable for use in electronic musical instruments, in which the musical instrument unit 19 is used as a device specialized in generating musical tones.

Further, in the embodiments, the infrared communication devices 24 and 33 are used to exchange an infrared signal of data between the performance apparatus 11 and the musical instrument unit 19, but the invention is not limited to the exchange of infrared signals. For example, data may be exchanged between percussion instruments 11 and the musical instrument unit 19 through other radio communication and/or wire communication in place of the infrared communication devices 24 and 33.

In the above embodiments, the sound-volume level of a musical tone to be generated is determined based on the first displacements, but the sound-volume level may be determined based on the maximum value of the sensor-combined values of the acceleration sensor values, or may be constant.

In the first embodiment of the invention, the tone colors are employed as the musical-tone composing elements, and the tone colors of musical tones to be generated are determined based on the operation modes. But musical-tone composing elements other than the tone color may be employed. For example, the sound-volume levels, pitches, and tone lengths may be employed as the musical-tone composing elements, and the sound-volume levels, pitches, and tone lengths of musical tones to be generated may be determined based on the operation modes. In the second and third embodiment of the invention, musical-tone composing elements other than the pitch may be employed.

In the second embodiment, the longitudinal direction of the performance apparatus 111 held at the time when the player has turned on the setting switch is set as the reference position, but the reference position is not limited to the longitudinal direction of the performance apparatus 111. The reference position may be set to the magnetic north. In this case, the process for setting the reference position is not required.

In the embodiments of the invention, tone colors of natural musical instruments such as pianos, toms, guitars, and trumpets can be selected (Refer to FIG. 11). But edited parameters in so-called sound effects such as reverb time, depth, depth in chorus, and resonance can be used in place of the tone colors of musical tones.

What is claimed is:

1. A performance apparatus used with musical-tone generating equipment for generating musical tones, the apparatus comprising:

a holding member extending in an longitudinal direction to be held by a player with his or her hand;

a first acceleration sensor provided in a head portion of the holding member, for obtaining a first acceleration-sensor value, which contains three components along three axes, respectively;

a second acceleration sensor provided in a base portion of the holding member, for obtaining a second acceleration-sensor value, which contains three components along said three axes, respectively, wherein the base portion of the holding member is a portion opposite to the head portion of the holding member; and a controlling unit for giving the musical-tone generating equipment an instruction of generating a musical tone;

wherein the controlling unit comprises:

a sound-generation instructing unit for obtaining a timing for a sound generation based on at least one of the first acceleration-sensor value obtained by the first acceleration sensor and the second acceleration-sensor value obtained by the second acceleration sensor and for giving an instruction of generating a musical tone to the musical-tone generating equipment at the obtained timing;

an operation-mode determining unit for determining an operation mode corresponding to an operation of the holding member based on the first acceleration-sensor value obtained by the first acceleration sensor and the second acceleration-sensor value obtained by the second acceleration sensor; and a musical-tone composing element determining unit for determining a musical-tone composing element of a musical tone to be generated, based on the operation mode determined by the operation-mode determining unit;

wherein the operation-mode determining unit calculates (i) a first displacement value of the head portion of the holding member during a period from a first timing to a second timing, based on the first acceleration-sensor value obtained by the first acceleration sensor, and (ii) a second displacement value of the base portion of the holding member during the period from the first timing to the second timing, based on the second acceleration-sensor value obtained by the second acceleration sensor, and determines the operation mode of the holding member based on the first displacement value and the second displacement value;

wherein the operation-mode determining unit calculates (i) the first displacement value based on a component among the three components of the first acceleration-sensor value along an axis among the three axes which is perpendicular to the longitudinal direction of the holding member, obtained by the first acceleration sensor, and (ii) the second displacement value based on a component among the three components of the second acceleration-sensor value along the axis perpendicular to the longitudinal direction of the holding member, obtained by the second acceleration sensor;

wherein the performance apparatus is operable in four operation modes including a first operation mode, a second operation mode, a third operation mode, and a fourth operation mode, wherein the operation-mode determining unit determines which of the four operation modes the operation of the holding member satisfies;

wherein the operation-mode determining unit determines that the operation of the holding member satisfies the first operation mode when the operation of the holding member meets conditions such that both an absolute value of the first displacement value and an absolute value of the second displacement value are larger than a first threshold value, and an absolute value of a difference between the first displacement value and the second displacement value is smaller than a second threshold value, the second threshold value being smaller than the first threshold value, and the first displacement value and the second displacement value have the same sign;

wherein the operation-mode determining unit determines that the operation of the holding member satisfies the second operation mode when the operation of the holding member meets conditions such that the absolute value of the first displacement value is larger than the first threshold value, and the absolute value of the second displacement value is smaller than the second threshold value;

wherein the operation-mode determining unit determines that the operation of the holding member satisfies the third operation mode when the operation of the holding member meets conditions such that the absolute value of the first displacement value is larger than the first threshold value, and the absolute value of the second displacement value falls into a range between the second threshold value and the first threshold value, and the first displacement value and the second displacement value have the same sign; and wherein the operation-mode determining unit determines that the operation of the holding member satisfies the fourth operation mode when the operation of the holding member meets conditions such that both the absolute value of the first displacement value and the absolute value of the second displacement value are larger than a third threshold value, and the first displacement value and the second displacement value have a different sign from each other.

2. The performance apparatus according to claim 1, wherein the operation-mode determining unit determines that a movement of the holding member starts at a time when a combined value of the components of one of the first acceleration-sensor value and the second acceleration-sensor value has increased larger than a predetermined value, and sets the first timing at such time, and determines that the movement of the holding member stops at a time when the combined value of the components of one of the first acceleration-sensor value and the second acceleration-sensor value has decreased smaller than a predetermined value after once increasing larger, and sets the second timing at such time.

3. The performance apparatus according to claim 1, further comprising:

a storing unit for storing data; and a table stored in the storing unit, in which the operation modes are associated with musical-tone composing elements, respectively, wherein the musical-tone composing element determining unit refers to the table stored in the storing unit, to determine a musical-tone composing element of a musical tone to be generated.

4. The performance apparatus according to claim 1, further comprising:

a magnetic sensor provided in the holding member, for obtaining a magnetic sensor value, wherein the controlling unit further comprises:

a difference-value obtaining unit for obtaining a difference value representing an angle between a predetermined reference direction and the longitudinal direction of the holding member, based on the magnetic sensor value obtained by the magnetic sensor; and a second musical-tone composing element determining unit for determining another musical-tone composing element of a musical tone to be generated, based on the difference value obtained by the difference-value obtaining unit.

5. The performance apparatus according to claim 1, further comprising:

an angular-rate sensor provided in the holding member, for obtaining an angular-rate sensor value, wherein the controlling unit further comprises:

a difference-value obtaining unit for obtaining a difference value representing an angle between a predetermined reference direction and the longitudinal direction of the holding member, based on the angular-rate sensor value obtained by the angular-rate sensor; and a second musical-tone composing element determining unit for determining another musical-tone composing element of a musical tone to be generated, based on the difference value obtained by the difference-value obtaining unit.

6. An electronic musical instrument, comprising:

a performance apparatus and a musical instrument unit provided with a musical-tone generating unit for generating musical tones, wherein both the performance apparatus and the musical instrument unit have a communication unit, and the performance apparatus comprises:

a holding member extending in an longitudinal direction to be held by a player with his or her hand;

a first acceleration sensor provided in a head portion of the holding member, for obtaining a first acceleration-sensor value, which contains three components along three axes, respectively;

a second acceleration sensor provided in a base portion of the holding member, for obtaining a second acceleration-sensor value, which contains three components along said three axes, respectively, wherein the base portion of the holding member is a portion opposite to the head portion of the holding member; and a controlling unit for giving an instruction of generating a musical tone to the musical-tone generating unit of the musical instrument unit, wherein the controlling unit comprises:

a sound-generation instructing unit for obtaining a timing for a sound generation based on at least one of the first acceleration-sensor value obtained by the first acceleration sensor and the second acceleration-sensor value obtained by the second acceleration sensor and for giving an instruction of generating a musical tone to the musical-tone generating unit at the obtained timing;

an operation-mode determining unit for determining an operation mode corresponding to an operation of the holding member based on the first acceleration-sensor value obtained by the first acceleration sensor and the second acceleration-sensor value obtained by the second acceleration sensor; and a musical-tone composing element determining unit for determining a musical-tone composing element of a musical tone to be generated, based on the operation mode determined by the operation-mode determining unit;

wherein the operation-mode determining unit calculates (i) a first displacement value of the head portion of the holding member during a period from a first timing to a second timing, based on the first acceleration-sensor value obtained by the first acceleration sensor, and (ii) a second displacement value of the base portion of the holding member during the period from the first timing to the second timing, based on the second acceleration-sensor value obtained by the second acceleration sensor, and determines the operation mode of the holding member based on the first displacement value and the second displacement value;

wherein the operation-mode determining unit calculates (i) the first displacement value based on a component among the three components of the first acceleration-sensor value along an axis among the three axes which is perpendicular to the longitudinal direction of the holding member, obtained by the first acceleration sensor, and (ii) the second displacement value based on a component among the three components of the second acceleration-sensor value along the axis perpendicular to the longitudinal direction of the holding member, obtained by the second acceleration sensor;

wherein the performance apparatus is operable in four operation modes including a first operation mode, a second operation mode, a third operation mode, and a fourth operation mode, wherein the operation-mode determining unit determines which of the four operation modes the operation of the holding member satisfies;

wherein the operation-mode determining unit determines that the operation of the holding member satisfies the first operation mode when the operation of the holding member meets conditions such that both an absolute value of the first displacement value and an absolute value of the second displacement value are larger than a first threshold value, and an absolute value of a difference between the first displacement value and the second displacement value is smaller than a second threshold value, the second threshold value being smaller than the first threshold value, and the first displacement value and the second displacement value have the same sign;

wherein the operation-mode determining unit determines that the operation of the holding member satisfies the second operation mode when the operation of the holding member meets conditions such that the absolute value of the first displacement value is larger than the first threshold value, and the absolute value of the second displacement value is smaller than the second threshold value;

wherein the operation-mode determining unit determines that the operation of the holding member satisfies the third operation mode when the operation of the holding member meets conditions such that the absolute value of the first displacement value is larger than the first threshold value, and the absolute value of the second displacement value falls into a range between the second threshold value and the first threshold value, and the first displacement value and the second displacement value have the same sign; and wherein the operation-mode determining unit determines that the operation of the holding member satisfies the fourth operation mode when the operation of the holding member meets conditions such that both the absolute value of the first displacement value and the absolute value of the second displacement value are larger than a third threshold value, and the first displacement value and the second displacement value have a different sign from each other.

7. A performance apparatus used with tone generating equipment for generating tones, the apparatus comprising:

a holding member extending in an longitudinal direction to be held by a player with his or her hand;

a first acceleration sensor provided in a head portion of the holding member, for obtaining a first acceleration-sensor value, which contains three components along three axes, respectively;

a second acceleration sensor provided in a base portion of the holding member, for obtaining a second acceleration-sensor value, which contains three components along said three axes, respectively, wherein the base portion of the holding member is a portion opposite to the head portion of the holding member; and a controlling unit for giving the tone generating equipment an instruction of generating a tone;

wherein the controlling unit comprises:

a sound-generation instructing unit for obtaining a timing for a sound generation based on at least one of the first acceleration-sensor value obtained by the first acceleration sensor and the second acceleration-sensor value obtained by the second acceleration sensor and for giving an instruction of generating a tone to the tone generating equipment at the obtained timing;

an operation-mode determining unit for determining an operation mode corresponding to an operation of the holding member based on the first acceleration-sensor value obtained by the first acceleration sensor and the second acceleration-sensor value obtained by the second acceleration sensor; and a tone composing element determining unit for determining a tone composing element of a tone to be generated, based on the operation mode determined by the operation-mode determining unit;

wherein the operation-mode determining unit calculates (i) a first displacement value of the head portion of the holding member during a period from a first timing to a second timing, based on the first acceleration-sensor value obtained by the first acceleration sensor, and (ii) a second displacement value of the base portion of the holding member during the period from the first timing to the second timing, based on the second acceleration-sensor value obtained by the second acceleration sensor, and determines the operation mode of the holding member based on the first displacement value and the second displacement value;

wherein the operation-mode determining unit calculates (i) the first displacement value based on a component among the three components of the first acceleration-sensor value along an axis among the three axes which is perpendicular to the longitudinal direction of the holding member, obtained by the first acceleration sensor, and (ii) the second displacement value based on a component among the three components of the second acceleration-sensor value along the axis perpendicular to the longitudinal direction of the holding member, obtained by the second acceleration sensor;

wherein the performance apparatus is operable in four operation modes including a first operation mode, a second operation mode, a third operation mode, and a fourth operation mode, wherein the operation-mode determining unit determines which of the four operation modes the operation of the holding member satisfies;

wherein the operation-mode determining unit determines that the operation of the holding member satisfies the first operation mode when the operation of the holding member meets conditions such that both an absolute value of the first displacement value and an absolute value of the second displacement value are larger than a first threshold value, and an absolute value of a difference between the first displacement value and the second displacement value is smaller than a second threshold value, the second threshold value being smaller than the first threshold value, and the first displacement value and the second displacement value have the same sign;

wherein the operation-mode determining unit determines that the operation of the holding member satisfies the second operation mode when the operation of the holding member meets conditions such that the absolute value of the first displacement value is larger than the first threshold value, and the absolute value of the second displacement value is smaller than the second threshold value;

wherein the operation-mode determining unit determines that the operation of the holding member satisfies the third operation mode when the operation of the holding member meets conditions such that the absolute value of the first displacement value is larger than the first threshold value, and the absolute value of the second displacement value falls into a range between the second threshold value and the first threshold value, and the first displacement value and the second displacement value have the same sign; and wherein the operation-mode determining unit determines that the operation of the holding member satisfies the fourth operation mode when the operation of the holding member meets conditions such that both the absolute value of the first displacement value and the absolute value of the second displacement value are larger than a third threshold value, and the first displacement value and the second displacement value have a different sign from each other.

8. A performance apparatus used with tone generating equipment for generating tones, the apparatus comprising:

a holding member extending in an longitudinal direction to be held by a player with his or her hand;

a first acceleration sensor provided in a head portion of the holding member, for obtaining a first acceleration-sensor value, which contains three components along three axes, respectively;

a second acceleration sensor provided in a base portion of the holding member, for obtaining a second acceleration-sensor value, which contains three components along said three axes, respectively, wherein the base portion of the holding member is a portion opposite to the head portion of the holding member; and a controlling unit for giving the tone generating equipment an instruction of generating a tone;

wherein the controlling unit comprises:

a sound-generation instructing unit for obtaining a timing for a sound generation based on at least one of the first acceleration-sensor value obtained by the first acceleration sensor and the second acceleration-sensor value obtained by the second acceleration sensor and for giving an instruction of generating a tone to the tone generating equipment at the obtained timing;

an operation-mode determining unit for determining an operation mode corresponding to an operation of the holding member based on the first acceleration-sensor value obtained by the first acceleration sensor and the second acceleration-sensor value obtained by the second acceleration sensor; and a tone composing element determining unit for determining a tone composing element of a tone to be generated, based on the operation mode determined by the operation-mode determining unit;

wherein the operation-mode determining unit calculates (i) a first displacement value of the head portion of the holding member during a period from a first timing to a second timing, based on the first acceleration-sensor value obtained by the first acceleration sensor, and (ii) a second displacement value of the base portion of the holding member during the period from the first timing to the second timing, based on the second acceleration-sensor value obtained by the second acceleration sensor, and determines the operation mode of the holding member based on the first displacement value and the second displacement value;

wherein the operation-mode determining unit calculates (i) the first displacement value based on a component among the three components of the first acceleration-sensor value along an axis among the three axes which is perpendicular to the longitudinal direction of the holding member, obtained by the first acceleration sensor, and (ii) the second displacement value based on a component among the three components of the second acceleration-sensor value along the axis perpendicular to the longitudinal direction of the holding member, obtained by the second acceleration sensor;

wherein the performance apparatus is operable in at least two of four operation modes including a first operation mode, a second operation mode, a third operation mode, and a fourth operation mode, wherein the operation-mode determining unit determines which of the at least two operation modes the operation of the holding member satisfies;

wherein the operation-mode determining unit determines that the operation of the holding member satisfies the first operation mode when the operation of the holding member meets conditions such that both an absolute value of the first displacement value and an absolute value of the second displacement value are larger than a first threshold value, and an absolute value of a difference between the first displacement value and the second displacement value is smaller than a second threshold value, the second threshold value being smaller than the first threshold value, and the first displacement value and the second displacement value have the same sign;

wherein the operation-mode determining unit determines that the operation of the holding member satisfies the second operation mode when the operation of the holding member meets conditions such that the absolute value of the first displacement value is larger than the first threshold value, and the absolute value of the second displacement value is smaller than the second threshold value;

wherein the operation-mode determining unit determines that the operation of the holding member satisfies the third operation mode when the operation of the holding member meets conditions such that the absolute value of the first displacement value is larger than the first threshold value, and the absolute value of the second displacement value falls into a range between the second threshold value and the first threshold value, and the first displacement value and the second displacement value have the same sign; and wherein the operation-mode determining unit determines that the operation of the holding member satisfies the fourth operation mode when the operation of the holding member meets conditions such that both the absolute value of the first displacement value and the absolute value of the second displacement value are larger than a third threshold value, and the first displacement value and the second displacement value have a different sign from each other.

* * * * *